US012180433B2

(12) United States Patent
Sato et al.

(10) Patent No.: US 12,180,433 B2
(45) Date of Patent: Dec. 31, 2024

(54) LUBRICATING OIL COMPOSITION, METHOD FOR USING LUBRICATING OIL COMPOSITION, AND METHOD FOR PRODUCING LUBRICATING OIL COMPOSITION

(71) Applicant: IDEMITSU KOSAN CO., LTD., Chiyoda-ku (JP)

(72) Inventors: Tokue Sato, Ichihara (JP); Kenji Goto, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 18/251,760

(22) PCT Filed: Dec. 23, 2021

(86) PCT No.: PCT/JP2021/047982

§ 371 (c)(1),
(2) Date: May 4, 2023

(87) PCT Pub. No.: WO2022/138852

PCT Pub. Date: Jun. 30, 2022

(65) Prior Publication Data

US 2023/0407202 A1 Dec. 21, 2023

(30) Foreign Application Priority Data

Dec. 25, 2020 (JP) ..... 2020-217796

(51) Int. Cl.
*C10M 169/04* (2006.01)
*C10N 20/02* (2006.01)
(Continued)

(52) U.S. Cl.
CPC .. *C10M 169/044* (2013.01); *C10M 2203/003* (2013.01); *C10M 2207/125* (2013.01);
(Continued)

(58) Field of Classification Search
CPC ..... C10M 169/044; C10M 2203/003; C10M 2207/125; C10M 2207/126;
(Continued)

(56) References Cited

U.S. PATENT DOCUMENTS 3,892,670 A * 7/1975 White ..... C10M 133/10 508/555
2008/0029430 A1* 2/2008 Loh ..... C10M 169/04 208/19

(Continued)

FOREIGN PATENT DOCUMENTS

EP 3 754 000 A1 12/2020
JP 11-323368 A 11/1999

(Continued)

OTHER PUBLICATIONS

International Search Report issued Mar. 15, 2022 in PCTJP2021/047982 (with English translation), 5 pages.

(Continued)

*Primary Examiner* — James C Goloboy
(74) *Attorney, Agent, or Firm* — Oblon, McClelland, Maier & Neustadt, L.L.P.

(57) ABSTRACT

A lubricating oil composition contains a base oil and a rust inhibitor, in which the base oil has a gas chromatogram measured by gas chromatography satisfying the particular condition (α), and the rust inhibitor is at least one selected from a first rust inhibitor, a second rust inhibitor, a third rust inhibitor, and a fourth rust inhibitor, and satisfies the particular condition (β).

20 Claims, 1 Drawing Sheet

(51) Int. Cl.

| | |
|---|---|
| ***C10N 30/00*** | (2006.01) |
| ***C10N 30/06*** | (2006.01) |
| ***C10N 30/10*** | (2006.01) |
| ***C10N 30/12*** | (2006.01) |
| ***C10N 30/18*** | (2006.01) |
| ***C10N 40/00*** | (2006.01) |

(52) U.S. Cl.
CPC . *C10M 2207/126* (2013.01); *C10M 2207/282* (2013.01); *C10M 2207/283* (2013.01); *C10M 2207/289* (2013.01); *C10M 2215/04* (2013.01); *C10M 2215/08* (2013.01); *C10M 2215/26* (2013.01); *C10M 2223/04* (2013.01); *C10M 2223/041* (2013.01); *C10M 2229/02* (2013.01); *C10N 2020/02* (2013.01); *C10N 2030/06* (2013.01); *C10N 2030/10* (2013.01); *C10N 2030/12* (2013.01); *C10N 2030/18* (2013.01); *C10N 2030/24* (2020.05); *C10N 2040/135* (2020.05)

(58) Field of Classification Search
CPC ..... C10M 2207/282; C10M 2207/283; C10M 2207/289; C10M 2215/04; C10M 2215/08; C10M 2215/25; C10M 2223/04; C10M 2223/041; C10M 2229/02; C10N 2020/02; C10N 2030/06; C10N 2030/10; C10N 2030/12; C10N 2030/18; C10N 2030/24; C10N 2040/135
See application file for complete search history.

(56) References Cited

U.S. PATENT DOCUMENTS

| | | | | |
|---|---|---|---|---|
| 2015/0361272 | A1 | 12/2015 | Yoshida et al. | |
| 2017/0327762 | A1 | 11/2017 | Nagakari | |
| 2019/0177648 | A1* | 6/2019 | Aoki | C10M 105/34 |
| 2021/0130730 | A1 | 5/2021 | Sekiguchi | |

FOREIGN PATENT DOCUMENTS

| | | | |
|---|---|---|---|
| JP | 2010-138265 | A | 6/2010 |
| JP | 2011/140642 | A | 7/2011 |
| JP | 2017-179197 | A | 10/2017 |
| JP | 2018/28024 | A | 2/2018 |
| WO | WO 2009/074664 | A1 | 6/2009 |
| WO | WO 2011/070140 | A2 | 6/2011 |
| WO | WO 2019/160123 | A1 | 8/2019 |

OTHER PUBLICATIONS

Written Opinion of the International Searching Authority issued on Mar. 15, 2022 in PCTJP2021/047982 (with English translation), 9 pages.
Office Action issued Oct. 17, 2024, in corresponding European Patent Application No. 21910991.5, 8 pages.

* cited by examiner

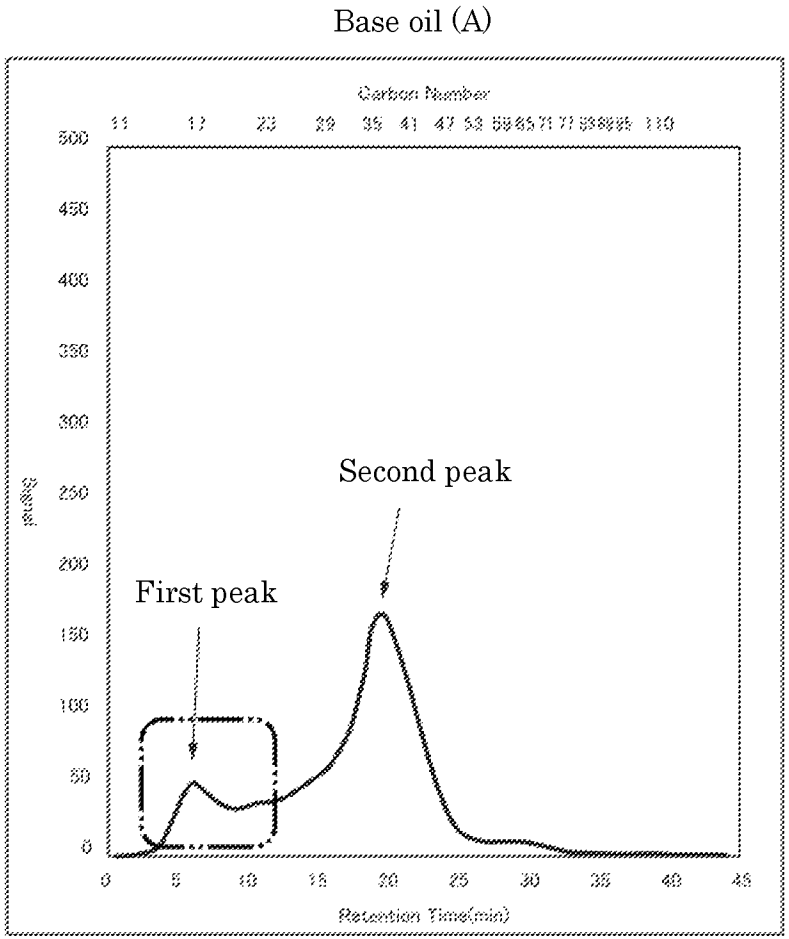
Base oil (A)
Carbon Number
Signal
Retention Time(min)
First peak
Second peak
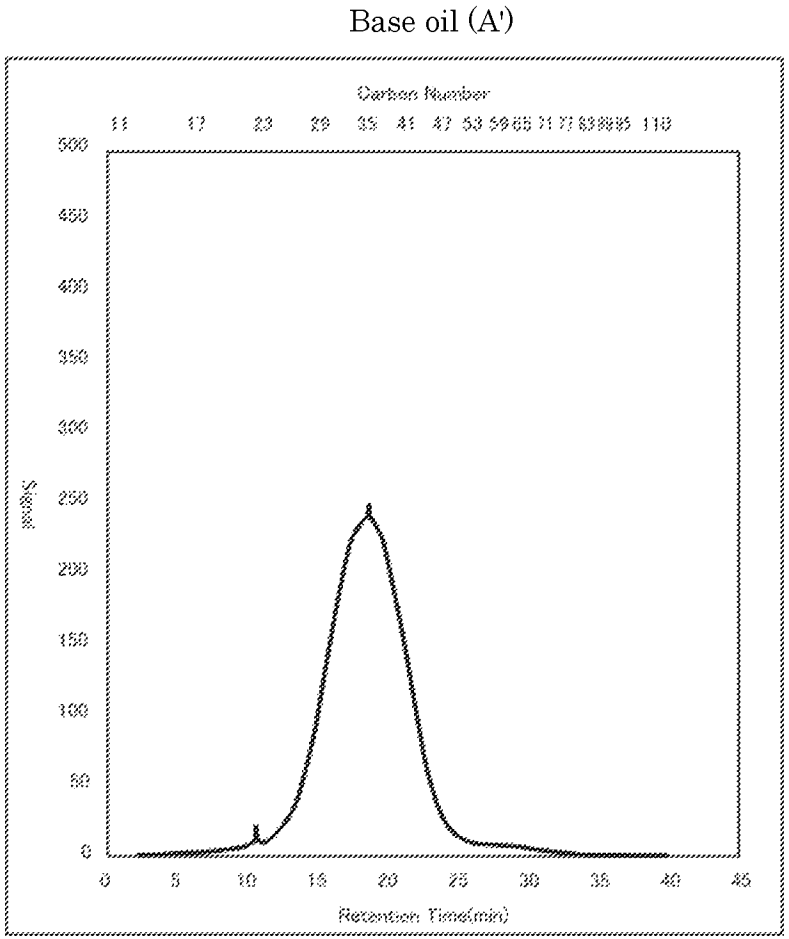
Base oil (A')
Carbon Number
Signal
Retention Time(min)

LUBRICATING OIL COMPOSITION, METHOD FOR USING LUBRICATING OIL COMPOSITION, AND METHOD FOR PRODUCING LUBRICATING OIL COMPOSITION

CROSS REFERENCE TO RELATED APPLICATIONS

This application is a National Stage entry under 35 U.S.C. § 371 of PCT/JP2021/047982, filed on Dec. 23, 2021, and claims priority to Japanese Patent Application No. 2020-217796, filed on Dec. 25, 2020, the entire contents of which are incorporated herein by reference.

TECHNICAL FIELD

The present invention relates to a lubricating oil composition and a use method and a production method of a lubricating oil composition.

BACKGROUND ART

Lubricating oil compositions used in equipments that may be contaminated with water or steam are demanded to have a rust inhibiting capability for inhibiting rust formed on the surface of the equipments.

For example, as a lubricating oil composition excellent in rust inhibiting capability, PTL 1 proposes a lubricating oil composition containing a hydrocarbon-based oil selected from a mineral oil and a synthetic oil containing 0.008 to 0.04% by mass of a sarcosine derivative, 0.01 to 0.07% by mass of an alkenylsuccinate, 0.1 to 3.0% by mass of an amine-based antioxidant, and 0.1 to 3.0% by mass of a phenol-based antioxidant, based on the total amount of the composition. In the lubricating oil composition, the sarcosine derivative and the alkenylsuccinate are added as a rust inhibitor.

CITATION LIST

Patent Literature

PTL 1: JP 2017-179197 A

SUMMARY OF INVENTION

Technical Problem

The present inventors have made earnest investigations on lubricating oil compositions used in equipments that may be contaminated with water or steam, by using various base oils from the standpoint of the diversification of the raw material procurement, and the like. As a result, it has been found that there are base oils, although in a few cases, that cannot sufficiently secure the rust inhibiting capability even by using a succinate alone, which has been ordinarily known as a rust inhibitor.

The present inventors have made earnest investigations for pursuing the cause of the phenomenon. As a result, it has been found that the base oils contain a polar substance that has a function significantly deteriorating the rust inhibiting capability, and thus the rust inhibiting capability cannot be sufficiently secured.

It has also been found that even in the case where the base oils are blended with the rust inhibitor containing the combination of a sarcosine derivative and an alkenylsuccinate proposed in PTL 1, the rust inhibiting capability cannot be sufficiently secured.

From the standpoint of the diversification of the raw material procurement, and the like, there is a demand to achieve sufficiently the rust inhibiting capability even for a few base oils failing to secure the rust inhibiting capability sufficiently by blending the ordinary rust inhibitor.

Under the circumstances, a problem to be solved by the present invention is to provide a lubricating oil composition having an excellent rust inhibiting capability even containing a base oil containing a polar substance that has a function significantly deteriorating the rust inhibiting capability, and a use method and a production method of the lubricating oil composition.

Solution to Problem

The present inventors have made earnest investigations for solving the problem. As a result, the inventors have found an indicator that identifies the base oil containing a polar substance that has a function significantly deteriorating the rust inhibiting capability, and also have found a rust inhibitor and a content thereof that are effective for the base oil, and after further investigations, the present invention has been completed.

Specifically, the present invention relates to the following items [1] to [3].

[1] A lubricating oil composition containing a base oil (A) and a rust inhibitor (B), the base oil (A) satisfying the following condition (a):

<Condition (α)> a gas chromatogram measured according to ASTM D7500 with a gas chromatography distillation equipment having a peak in a range of a number of carbon atoms of more than 11 and less than 23, the rust inhibitor (B) being one or more kind selected from the group consisting of a first rust inhibitor (B1), a second rust inhibitor (B2), a third rust inhibitor (B3), and a fourth rust inhibitor (B4):

the first rust inhibitor (B1): a combination of a succinate (B1-1) and a sorbitan fatty acid ester (B1-2), the second rust inhibitor (B2): a carboxylic acid amide (B2-1), the third rust inhibitor (B3): a neutral alkyl phosphate (B3-1), and the fourth rust inhibitor (B4): a combination of a fatty acid having 12 or more carbon atoms (B4-1) and a primary amine (B4-2), having contents of the first rust inhibitor (B1), the second rust inhibitor (B2), the third rust inhibitor (B3), and the fourth rust inhibitor (B4) satisfying the following condition (ß) based on the total amount of the lubricating oil composition:

<Condition (ß)> the first rust inhibitor (B1): more than 0.02% by mass and less than 0.16% by mass, the second rust inhibitor (B2): more than 0.05% by mass and 0.5% by mass or less, the third rust inhibitor (B3): 0.005% by mass or more and less than 0.05% by mass, and the fourth rust inhibitor (B4): more than 0.05% by mass and less than 0.20% by mass.

[2] A method for using a lubricating oil composition, including using the lubricating oil composition according to the item [1] as a turbine oil

[3] A method for producing a lubricating oil composition, including mixing a base oil (A) and a rust inhibitor (B), the base oil (A) satisfying the following condition (a):

<Condition (α)> a gas chromatogram measured according to ASTM D7500 with a gas chromatography distillation equipment having a peak in a range of a number of carbon atoms of more than 11 and less than 23, the rust inhibitor (B) being one or more kind selected from the group consisting of a first rust inhibitor (B1), a second rust inhibitor (B2), a third rust inhibitor (B3), and a fourth rust inhibitor (B4):

the first rust inhibitor (B1): a combination of a succinate (B1-1) and a sorbitan fatty acid ester (B1-2), the second rust inhibitor (B2): a carboxylic acid amide (B2-1), the third rust inhibitor (B3): a neutral alkyl phosphate (B3-1), and the fourth rust inhibitor (B4): a combination of a fatty acid having 12 or more carbon atoms (B4-1) and a primary amine (B4-2), blending amounts of the first rust inhibitor (B1), the second rust inhibitor (B2), the third rust inhibitor (B3), and the fourth rust inhibitor (B4) satisfying the following condition (B) based on the total amount of the lubricating oil composition:

<Condition (ß)> the first rust inhibitor (B1): more than 0.02% by mass and less than 0.16% by mass, the second rust inhibitor (B2): more than 0.05% by mass and 0.5% by mass or less, the third rust inhibitor (B3): 0.005% by mass or more and less than 0.05% by mass, and the fourth rust inhibitor (B4): more than 0.05% by mass and less than 0.20% by mass.

Advantageous Effects of Invention

According to the present invention, a lubricating oil composition having an excellent rust inhibiting capability even containing a base oil containing a polar substance that has a function significantly deteriorating the rust inhibiting capability, and a use method and a production method of the lubricating oil composition can be provided.

BRIEF DESCRIPTION OF DRAWING

FIG. 1 shows the gas chromatograms of the base oil (A) that satisfies the condition (α) and the base oil (A') that does not satisfy the condition (α).

DESCRIPTION OF EMBODIMENTS

The upper limit values and the lower limit values of the numerical ranges shown in the description herein may be optionally combined. For example, in the case where "A to B" and "C to D" are shown as numerical ranges, numerical ranges "A to D" and "C to B" are also encompassed in the present invention.

The numerical range "(lower limit value) to (upper limit value)" shown in the description herein means the lower limit value or more and the upper limit value or less unless otherwise indicated.

The numerical values in Examples in the description herein are numerical values that can be used as the upper limit value or the lower limit value.

Embodiments of Lubricating Oil Composition of Present Invention

The lubricating oil composition of the present invention contains a base oil (A) and a rust inhibitor (B).

The base oil (A) satisfies the following condition (α).

<Condition (α)>

The gas chromatogram measured according to ASTM D7500 with a gas chromatography distillation equipment has a peak in a range of a number of carbon atoms of more than 11 and less than 23.

The rust inhibitor (B) is one or more kind selected from the group consisting of a first rust inhibitor (B1), a second rust inhibitor (B2), a third rust inhibitor (B3), and a fourth rust inhibitor (B4).

The first rust inhibitor (B1): a combination of a succinate (B1-1) and a sorbitan fatty acid ester (B1-2)

The second rust inhibitor (B2): a carboxylic acid amide (B2-1)

The third rust inhibitor (B3): a neutral alkyl phosphate (B3-1)

The fourth rust inhibitor (B4): a combination of a fatty acid having 12 or more carbon atoms (B4-1) and a primary amine (B4-2)

The contents of the first rust inhibitor (B1), the second rust inhibitor (B2), the third rust inhibitor (B3), and the fourth rust inhibitor (B4) satisfy the following condition (ß) based on the total amount of the lubricating oil composition.

<Condition (ß)>

The first rust inhibitor (B1): more than 0.02% by mass and less than 0.16% by mass The second rust inhibitor (B2): more than 0.05% by mass and 0.5% by mass or less The third rust inhibitor (B3): 0.005% by mass or more and less than 0.05% by mass The fourth rust inhibitor (B4): more than 0.05% by mass and less than 0.20% by mass The present inventors have made the earnest investigations for solving the problem, and as a result, have found the condition (a) as an indicator that identifies the base oil containing a polar substance that has a function significantly deteriorating the rust inhibiting capability.

The present inventors have confirmed the following items (1) and (2) in the process of various investigations. Therefore, it is apparent that the substance that has a function significantly deteriorating the rust inhibiting capability is a polar substance, and the polar substance significantly deteriorates the rust inhibiting capability of the lubricating oil composition.

(1) A base oil satisfying the condition (α) is subjected to a white clay treatment to extract the polar substance, and the polar substance thus extracted is added to a base oil not satisfying the condition (α) to prepare a base oil satisfying the condition (α). A lubricating oil composition is prepared by using the base oil, and investigated for the rust inhibiting capability, and it has been found that occurrence of rust is accelerated.

(2) A base oil satisfying the condition (α) is subjected to a white clay treatment to remove the polar substance from the base oil to prepare a base oil not satisfying the condition (α). A lubricating oil composition is prepared by using the base oil, and as a result, it has been found that occurrence of rust is suppressed.

The present inventors have then made the earnest investigations for securing an excellent rust inhibiting capability of the lubricating oil composition containing a base oil satisfying the condition (α). As a result, it has been found that a combination of a succinate and a sorbitan fatty acid ester (first rust inhibitor (B1)), a carboxylic acid amide (second rust inhibitor (B2)), a fatty acid phosphate (third rust inhibitor (B3)), or a combination of a fatty acid having 12 or more carbon atoms (B4-1) and a primary amine (B4-2) (fourth rust inhibitor (B4)) that is regulated to a content satisfying the condition (3) can be allowed to function as a rust inhibitor effective for the base oil satisfying the condition (α), and after further investigations, the present invention has been completed.

In the following description, the "base oil (A)" and the "rust inhibitor (B)" may be referred to as a "component (A)" and a "component (B)", respectively.

The "first rust inhibitor (B1)", the "second rust inhibitor (B2)", the "third rust inhibitor (B3)", and the "fourth rust inhibitor (B4)" may be referred to as a "component (B1)", a "component (B2)", a "component (B3)", and a "component (B4)", respectively.

The lubricating oil composition of one embodiment of the present invention may not contain a component other than the component (A) and the component (B), but preferably further contains one or more kind of an additive selected from the group consisting of an antioxidant (C), an anti-wear agent (D), and an anti-foaming agent (E).

In the following description, the "antioxidant (C)", the "anti-wear agent (D)", and the "anti-foaming agent (E)" may be referred to as a "component (C)", a "component (D)", and a "component (E)", respectively.

In the lubricating oil composition of one embodiment of the present invention, the total content of the component (A) and the component (B) is preferably 80% by mass or more, more preferably 90% by mass or more, and further preferably 95% by mass or more, based on the total amount of the lubricating oil composition. The total content thereof is preferably less than 100% by mass, more preferably 99.9% by mass or less, and further preferably 99.5% by mass or less.

The upper limit values and the lower limit values of the numerical ranges may be optionally combined. For example, the total content thereof is preferably 80% by mass to less than 100% by mass, more preferably 90% by mass to 99.9% by mass, and further preferably 95% by mass to 99.5% by mass.

The components contained in the lubricating oil composition of the present invention will be described in detail below.

[Base Oil (A)]

The lubricating oil composition of the present invention contains a base oil (A).

The base oil (A) satisfies the following condition (α).

<Condition (α)>

The gas chromatogram measured according to ASTM D7500 with a gas chromatography distillation equipment has a peak in a range of a number of carbon atoms of more than 11 and less than 23.

The base oil (A) satisfying the condition (α) contains a polar substance that has a function significantly deteriorating the rust inhibiting capability. The peak showing the existence of the polar substance in the gas chromatogram is a peak existing in a range of a number of carbon atoms of more than 11 and less than 23 (which may be hereinafter referred to as a "first peak") (see Base Oil (A) in FIG. 1).

The white clay treatment of the base oil satisfying the condition (α) eliminates the first peak. Therefore, the substance ascribed to the first peak is a polar substance having more than 11 and less than 23 carbon atoms capable of being removed by the white clay treatment.

The number of carbon atoms of the polar substance can be more specifically narrowed down into the following ranges (α1) to (α3). Therefore, the range of the number of carbon atoms where the first peak exists can also be narrowed down into the following ranges (α1) to (α3).

(α1): 12 or more and 22 or less carbon atoms (α2): 13 or more and 21 or less carbon atoms (α3): 14 or more and 20 or less carbon atoms The gas chromatogram can be measured by employing the apparatus and the conditions shown in Examples described later.

<Content of Base Oil (A)>

In the lubricating oil composition of one embodiment of the present invention, the content of the base oil (A) is preferably 90.0% by mass or more, more preferably 95.0% by mass or more, and further preferably 97.0% by mass or more, based on the total amount of the lubricating oil composition. The content thereof is preferably 99.5% by mass or less, more preferably 99.2% by mass or less, and further preferably 99.0% by mass or less.

The upper limit values and the lower limit values of the numerical ranges may be optionally combined. For example, the content thereof is preferably 90.0% by mass to 99.5% by mass, more preferably 95.0% by mass to 99.2% by mass, and further preferably 97.0% by mass to 99.0% by mass.

(Kind of Base Oil (A))

Any base oil that satisfies the condition (α) can be used as the base oil (A) with no particular limitation.

Examples of the base oil (A) satisfying the condition (α) include an atmospheric residue obtained through atmospheric distillation of a crude oil, such as a paraffin-based crude oil, an intermediate-based crude oil, and a naphthene-based crude oil; a distillate obtained through reduced-pressure distillation of the atmospheric residue; a mineral oil or wax (such as slack wax and GTL wax) obtained through one or more purification treatment including solvent deasphalting, solvent extraction, hydrorefining, solvent dewaxing, catalytic dewaxing, isomerization dewaxing, and reduced-pressure distillation of the distillate; and a hydrocarbon-based base oil, such as an isoparaffin polymer.

In the case where the base oil (A) is one or more kind of a base oil selected from a paraffin-based mineral oil and a hydrocarbon-based oil, the measurement of a gas chromatogram measured according to ASTM D7500 with a gas chromatography distillation equipment as defined in the condition (α) also shows a peak detected in a range of a number of carbon atoms of 23 or more and 50 or less (which may be hereinafter referred to as a "second peak") (see Base Oil (A) in FIG. 1). The second peak is a peak ascribed to the one or more kind of a base oil selected from a paraffin-based mineral oil and a hydrocarbon-based oil (i.e., the major component of the base oil).

In the case where the gas chromatogram shows the second peak in this manner, the intensity ratio [(first peak intensity)/(second peak intensity)] of the first peak and the second peak in the gas chromatogram is not particularly limited, and is preferably 0.50 or less, more preferably 0.40 or less, and further preferably 0.35 or less, from the standpoint of the effects of the present invention exerted by the rust inhibitor (B) and the condition (ß). The intensity ratio may be 0.10 or more, may be 0.20 or more, and may be 0.25 or more.

The number of carbon atoms of the second peak can be narrowed down into the following ranges (ß1) to (ß3).

(ß1): 25 or more and 50 or less carbon atoms (ß2): 30 or more and 45 or less carbon atoms (ß3): 35 or more and 45 or less carbon atoms (Flash Point of Base Oil (A))

In one embodiment of the present invention, the base oil (A) preferably has a high flash point from the standpoint of the safety and the handleability in storage and transportation. Specifically, the flash point of the base oil (A) is preferably 250° C. or more. The upper limit value of the flash point of the base oil (A) is not particularly limited, and is generally 400° C. or less.

In the description herein, the flash point of the base oil (A) is a value that is measured according to JIS K2265-4:2007 (Determination of flash points, Part 4: Cleveland open cup method) by the Cleveland open-cup method.

(Density at 15° C. of Base Oil (A))

In one embodiment of the present invention, the density at 15° C. of the base oil (A) is preferably 0.9000 g/cm$^3$ or less, more preferably 0.8500 g/cm$^3$ or less, and further preferably 0.8300 g/cm$^3$ or less, and is preferably 0.8000 g/cm$^3$ or more.

The upper limit values and the lower limit values of the numerical ranges may be optionally combined. Specifically, the density thereof is preferably 0.8000 g/cm$^3$ to 0.9000 g/cm$^3$, more preferably 0.8000 g/cm$^3$ to 0.8500 g/cm$^3$, and further preferably 0.8000 g/cm$^3$ to 0.8300 g/cm$^3$.

(Kinematic Viscosity at 100° C. and Viscosity Index of Base Oil (A))

In one embodiment of the present invention, the kinematic viscosity at 100° C. (which may be hereinafter referred to as a "100° C. kinematic viscosity") of the base oil (A) is preferably 3.00 mm$^2$/s or more, more preferably 5.00 mm$^2$/s or more, and further preferably 7.50 mm$^2$/s or more. The 100° C. kinematic viscosity thereof is preferably 15.0 mm$^2$/s or less, more preferably 10.0 mm$^2$/s or less, and further preferably 9.00 mm$^2$/s or less.

The upper limit values and the lower limit values of the numerical ranges may be optionally combined. Specifically, the 100° C. kinematic viscosity thereof is preferably 3.00 mm$^2$/s to 15.0 mm$^2$/s, more preferably 5.00 mm$^2$/s to 10.0 mm$^2$/s, and further preferably 7.50 mm$^2$/s to 9.00 mm$^2$/s.

In one embodiment of the present invention, the viscosity index of the base oil (A) is preferably 100 or more, more preferably 110 or more, and further preferably 120 or more, and is generally 150 or less.

In the description herein, the 100° C. kinematic viscosity and the viscosity index of the base oil (A) are values that are measured or calculated according to JIS K2283:2000.

(Preferred Embodiments of Base Oil (A))

In one embodiment of the present invention, the base oil (A) preferably satisfies the following condition (γ) in addition to the condition (α) from the standpoint of facilitating the excellent viscosity characteristics and the preparation of the lubricating oil composition having a high flash point.

<Condition (γ)>

- A flash point by Cleveland open cup method: 250° C. or more
- A density at 15° C.: 0.8300 g/cm$^3$ or less
- A viscosity index of 100 or more
- A 100° C. kinematic viscosity: 7.50 mm$^2$/s or more and 9.00 mm$^2$/s or less

[Rust Inhibitor (B)]

The lubricating oil composition of the present invention contains a rust inhibitor (B).

In the lubricating oil composition of the present invention, the rust inhibitor (B) is one or more kind selected from the group consisting of a first rust inhibitor (B1), a second rust inhibitor (B2), a third rust inhibitor (B3), and a fourth rust inhibitor (B4).

The first rust inhibitor (B1): a combination of a succinate (B1-1) and a sorbitan fatty acid ester (B1-2)

The second rust inhibitor (B2): a carboxylic acid amide (B2-1)

The third rust inhibitor (B3): a neutral alkyl phosphate (B3-1)

The fourth rust inhibitor (B4): a combination of a fatty acid having 12 or more carbon atoms (B4-1) and a primary amine (B4-2)

In the lubricating oil composition of one embodiment of the present invention, the rust inhibitor (B) is preferably one kind selected from the group consisting of the first rust inhibitor (B1), the second rust inhibitor (B2), the third rust inhibitor (B3), and the fourth rust inhibitor (B4).

In the lubricating oil composition of one embodiment of the present invention, the rust inhibitor (B) is preferably the first rust inhibitor (B1) or the second rust inhibitor (B2) from the standpoint of the achievement of the lubricating oil composition excellent in demulsibility.

In the lubricating oil composition of the present invention, the contents of the first rust inhibitor (B1), the second rust inhibitor (B2), the third rust inhibitor (B3), and the fourth rust inhibitor (B4) satisfy the following condition (ß) based on the total amount of the lubricating oil composition.

<Condition (ß)>

The first rust inhibitor (B1): more than 0.02% by mass and less than 0.16% by mass The second rust inhibitor (B2): more than 0.05% by mass and 0.5% by mass or less The third rust inhibitor (B3): 0.005% by mass or more and less than 0.05% by mass The fourth rust inhibitor (B4): more than 0.05% by mass and less than 0.20% by mass The details of the first rust inhibitor (B1), the second rust inhibitor (B2), the third rust inhibitor (B3), and the fourth rust inhibitor (B4) will be described below while referring to the condition (ß).

<First Rust Inhibitor (B1)>

The first rust inhibitor (B1) is a combination of a succinate (B1-1) and a sorbitan fatty acid ester (B1-2).

(Succinate (B1-1))

The first rust inhibitor (B1) contains a succinate (B1-1).

The single use of the succinate (B1-1) cannot exert a sufficient rust inhibiting capability to the base oil (A) satisfying the condition (α). However, the combination use thereof with the sorbitan fatty acid ester (B1-2) exerts an excellent rust inhibiting capability to the base oil (A) satisfying the condition (α).

The succinate (B1-1) is not particularly limited, as far as the effects of the present invention can be exerted, and one kind thereof may be used alone, or two or more kinds thereof may be used in combination.

In one embodiment of the present invention, the succinate (B1-1) is preferably an ester of an alkenylsuccinic acid and a polyhydric alcohol (i.e., a polyhydric alcohol alkenylsuccinate) from the standpoint of facilitating the exertion of the effects of the present invention and the standpoint of the storage stability. The ester is preferably a half ester.

Examples of the alkenylsuccinic acid constituting the polyhydric alcohol alkenylsuccinate ester include an alkenylsuccinic acid having preferably 8 to 28 carbon atoms, more preferably 10 to 24 carbon atoms, and further preferably 12 to 20 carbon atoms.

Preferred examples of the polyhydric alcohol constituting the polyhydric alcohol alkenylsuccinate include a diol and a polyol having 3 to 20 hydroxy groups.

Examples of the diol include ethylene glycol, propanediol, butanediol, pentanediol, hexanediol, heptanediol, octanediol, nonanediol, decanediol, undecanediol, and dodecanediol. The aliphatic hydrocarbon group constituting the diol may be a linear group or a branched group.

Examples of the polyol having 3 to 20 hydroxy groups include a polyhydric alcohol, such as trimethylolethane, trimethylolpropane, trimethylolbutane, trimethylolpentane, trimethylolhexane, trimethylolheptane, di(trimethylolpropane), tri(trimethylolpropane), pentaerythritol, di(pentaerythritol), tri(pentaerythritol), glycerin, polyglycerin (dimer to icosamer of glycerin), 1,3,5-pentanetriol, sorbitol, sorbitan, a sorbitol-glycerin condensate, adonitol, arabitol, xylitol, and mannitol; a saccharide, such as xylose, arabinose, ribose, rhamnose, glucose, fructose, galactose, mannose, sorbose, cellobiose, maltose, isomaltose, trehalose, sucrose, raffinose, gentianose, and melezitose; and partial ethers and methyl glucosides (glycosides) thereof.

(Sorbitan Fatty Acid Ester (B1-2))

The first rust inhibitor (B1) contains a sorbitan fatty acid ester (B1-2).

The single use of the sorbitan fatty acid ester (B1-2) cannot exert a sufficient rust inhibiting capability to the base oil (A) satisfying the condition (α). However, the combination use thereof with the succinate (B1-1) exerts an excellent rust inhibiting capability to the base oil (A) satisfying the condition (α).

The sorbitan fatty acid ester (B1-2) is not particularly limited, as far as the effects of the present invention can be exerted, and one kind thereof may be used alone, or two or more kinds thereof may be used in combination.

In one embodiment of the present invention, the sorbitan fatty acid ester (B1-2) is preferably an ester compound of sorbitan and a fatty acid having 12 or more and 30 or less carbon atoms from the standpoint of facilitating the exertion of the effects of the present invention.

Specific examples of a compound preferred as the sorbitan fatty acid ester (B1-2) include sorbitan laurate, sorbitan tridecanoate, sorbitan myristate, sorbitan pentadecanoate, sorbitan palmitate, sorbitan margarate, sorbitan stearate, sorbitan oleate, sorbitan nonadecanoate, sorbitan arachidate, sorbitan eicosenoate, sorbitan heneicosanoate, sorbitan behenate, sorbitan erucate, sorbitan tricosylate, and sorbitan lignocerate. The aliphatic hydrocarbon group of the fatty acid constituting the sorbitan fatty acid ester (B1-2) may be a linear group or a branched group.

The sorbitan fatty acid ester (B1-2) is preferably an ester compound with a fatty acid having 12 or more and 20 or less carbon atoms, more preferably an ester compound with a fatty acid having 16 or more and 20 or less carbon atoms, and further preferably sorbitan oleate, from the standpoint of facilitating the exertion of the effects of the present invention.

The ester valence of the sorbitan fatty acid ester is not particularly limited, and is preferably 1, 2, or 3.

(Content of First Rust Inhibitor (B1))

In the case where the lubricating oil composition of the present invention contains the first rust inhibitor (B1), the content of the first rust inhibitor (B1) is more than 0.02% by mass and less than 0.16% by mass based on the total amount of the lubricating oil composition as defined in the condition (ß).

In the case where the content of the first rust inhibitor (B1) is 0.02% by mass or less or 0.16% by mass or more based on the total amount of the lubricating oil composition, a sufficient rust inhibiting capability cannot be exerted to the base oil (A) satisfying the condition (α).

In one embodiment of the present invention, the content of the first rust inhibitor (B1) defined in the condition (ß) is preferably 0.03% by mass or more, more preferably 0.05% by mass or more, further preferably 0.07% by mass or more, and still further preferably 0.08% by mass or more, based on the total amount of the lubricating oil composition, from the standpoint of facilitating the further enhancement of the rust inhibiting capability and the standpoint of achieving the lubricating oil composition excellent in demulsibility. The content thereof is preferably 0.15% by mass or less, more preferably 0.14% by mass or less, further preferably 0.13% by mass or less, and still further preferably 0.12% by mass or less.

The upper limit values and the lower limit values of the numerical ranges may be optionally combined. Specifically, the content thereof is preferably 0.03% by mass to 0.15% by mass, more preferably 0.05% by mass to 0.14% by mass, further preferably 0.07% by mass to 0.13% by mass, and still further preferably 0.08% by mass to 0.12% by mass.

(Content Ratio of Succinate (B1-1) and Sorbitan Fatty Acid Ester (B1-2))

The lubricating oil composition of one embodiment of the present invention preferably has a content ratio [(B1-1)/(B1-2)] of the succinate (B1-1) and the sorbitan fatty acid ester (B1-2) in terms of mass ratio of 0.1 or more and 5.0 or less from the standpoint of facilitating the exertion of the effects of the present invention.

The content ratio [(B1-1)/(B1-2)] is preferably 0.2 or more, more preferably 0.5 or more, and further preferably 0.8 or more, from the standpoint of facilitating the exertion of the effects of the present invention. The content ratio is preferably 4.0 or less, more preferably 2.0 or less, and further preferably 1.2 or less.

The upper limit values and the lower limit values of the numerical ranges may be optionally combined. Specifically, the content ratio is preferably 0.2 to 4.0, more preferably 0.5 to 2.0, and further preferably 0.8 to 1.2.

(Content of Succinate (B1-1))

The lubricating oil composition of one embodiment of the present invention preferably has a content of the succinate (B1-1) of more than 0.01% by mass, more preferably 0.02% by mass or more, further preferably 0.03% by mass or more, and still further preferably 0.04% by mass or more, based on the total amount of the lubricating oil composition, from the standpoint of facilitating the exertion of the effects of the present invention. The content thereof is preferably less than 0.08% by mass, more preferably 0.07% by mass or less, and further preferably 0.06% by mass or less.

The upper limit values and the lower limit values of the numerical ranges may be optionally combined. Specifically, the content thereof is preferably more than 0.01% by mass to less than 0.08% by mass, more preferably 0.02% by mass to by mass, further preferably 0.03% by mass to 0.07% by mass, and still further preferably 0.04% by mass to 0.06% by mass.

(Content of Sorbitan Fatty Acid Ester (B1-2))

The lubricating oil composition of one embodiment of the present invention preferably has a content of the sorbitan fatty acid ester (B1-2) of more than 0.01% by mass, more preferably 0.02% by mass or more, further preferably 0.03% by mass or more, and still further preferably 0.04% by mass or more, based on the total amount of the lubricating oil composition, from the standpoint of facilitating the exertion of the effects of the present invention. The content thereof is preferably less than 0.08% by mass, more preferably 0.07% by mass or less, and further preferably 0.06% by mass or less.

The upper limit values and the lower limit values of the numerical ranges may be optionally combined. Specifically, the content thereof is preferably more than 0.01% by mass to less than 0.08% by mass, more preferably 0.02% by mass to by mass, further preferably 0.03% by mass to 0.07% by mass, and still further preferably 0.04% by mass to 0.06% by mass.

<Second Rust Inhibitor (B2)>

The second rust inhibitor (B2) is a carboxylic acid amide (B2-1).

(Carboxylic Acid Amide (B2-1))

The carboxylic acid amide (B2-1) is not particularly limited, as far as the effects of the present invention can be exerted, and one kind thereof may be used alone, or two or more kinds thereof may be used in combination.

In one embodiment of the present invention, the carboxylic acid amide (B2-1) is preferably a carboxylic acid amide having an acid value of 80 mgKOH/g or less from the standpoint of facilitating the exertion of the effects of the present invention. The acid value is more preferably 70 mgKOH/g or less, and further preferably 65 mgKOH/g or less. The lower limit value of the acid value is not particularly limited, and is generally 10 mgKOH/g or more.

The acid value of the carboxylic acid amide is a value that is measured according to JIS K2501:2003-5 (indicator titration method).

Specific examples of a compound preferred as the carboxylic acid amide (B2-1) include carboxylic acid amides obtained through reaction of a carboxylic acid, such as caproic acid, caprylic acid, capric acid, lauric acid, myristic acid, palmitic acid, stearic acid, arachinic acid, behenic acid, lignoceric acid, zoomaric acid, oleic acid, linoleic acid, linolenic acid, gadoleic acid, erucic acid, selacholeic acid, ricinoleic acid, a hydroxystearic acid, an alkenylsuccinic anhydride, and an alkylsuccinic anhydride, with an amine (ammonia).

The carboxylic acid is preferably an alkenylsuccinic anhydride or an alkylsuccinic anhydride, and more preferably an alkenylsuccinic anhydride. The number of carbon atoms of the alkenyl group of the alkenylsuccinic anhydride and the alkyl group of the alkylsuccinic anhydride is preferably 11 to 13 in consideration of the solubility in a base oil and the rust inhibiting capability.

Preferred examples of the amine include a polyalkylenepolyamine. Examples of the polyalkylenepolyamine include diethylenetriamine, triethylenetetramine, tetraethylenepentamine, pentaethylenehexamine, hexaethyleneheptamine, and hexaethyleneoctamine. Among these, triethylenetetramine is preferred.

The carboxylic acid amide (B2-1) is also preferably a carboxylic acid alkanolamide. Specific examples of the carboxylic acid alkanolamide include lauric acid diethanolamide, oleic acid diethanolamide, stearic acid diethanolamide, oleic acid monoethanolamide, oleic acid monopropanolamide, and oleic acid dipropanolamide.

(Content of Second Rust Inhibitor (B2))

In the case where the lubricating oil composition of the present invention contains the second rust inhibitor (B2), the content of the second rust inhibitor (B2) is more than 0.05% by mass and 0.5% by mass or less based on the total amount of the lubricating oil composition as defined in the condition (ß).

In the case where the content of the second rust inhibitor (B2) is 0.05% by mass or less or more than 0.5% by mass based on the total amount of the lubricating oil composition, a sufficient rust inhibiting capability cannot be exerted to the base oil (A) satisfying the condition (α).

In one embodiment of the present invention, the content of the second rust inhibitor (B2) defined in the condition (ß) is preferably 0.06% by mass or more, more preferably 0.08% by mass or more, and further preferably 0.10% by mass or more, based on the total amount of the lubricating oil composition, from the standpoint of facilitating the further enhancement of the rust inhibiting capability and the standpoint of achieving the lubricating oil composition excellent in demulsibility. The content thereof is preferably 0.40% by mass or less, more preferably 0.30% by mass or less, further preferably 0.25% by mass or less, and still further preferably 0.20% by mass or less.

The upper limit values and the lower limit values of the numerical ranges may be optionally combined. Specifically, the content thereof is preferably 0.06% by mass to 0.40% by mass, more preferably 0.08% by mass to 0.30% by mass, further preferably 0.08% by mass to 0.25% by mass, and still further preferably 0.10% by mass to 0.20% by mass.

<Third Rust Inhibitor (B3)>

The third rust inhibitor (B3) is a neutral alkyl phosphate (B3-1).

(Neutral Alkyl Phosphate (B3-1))

The neutral alkyl phosphate (B3-1) is not particularly limited, as far as the effects of the present invention can be exerted, and one kind thereof may be used alone, or two or more kinds thereof may be used in combination.

The neutral alkyl phosphate (B3-1) used is preferably, for example, a compound represented by the following general formula (b3-1).

(b3-1)

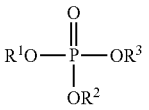

In the general formula (b3-1), $R^1$ to $R^3$ each independently represent an alkyl group having 3 to 14 carbon atoms.

Examples of the alkyl group having 3 to 14 carbon atoms that can be selected as $R^1$ to $R^3$ include a propyl group, a butyl group, a pentyl group, a hexyl group, a heptyl group, an octyl group, a nonyl group, a decyl group, an undecyl group, a dodecyl group, a tridecyl group, and a tetradecyl group.

These alkyl groups each may be a linear group or a branched group.

(Content of Third Rust Inhibitor (B3))

In the case where the lubricating oil composition of the present invention contains the third rust inhibitor (B3), the content of the third rust inhibitor (B3) is by mass or more and less than 0.05% by mass based on the total amount of the lubricating oil composition as defined in the condition (ß).

In the case where the content of the third rust inhibitor (B3) is less than by mass or 0.05% by mass or more based on the total amount of the lubricating oil composition, a sufficient rust inhibiting capability cannot be exerted to the base oil (A) satisfying the condition (α).

In one embodiment of the present invention, the content of the third rust inhibitor (B3) defined in the condition (ß) is preferably 0.006% by mass to 0.04% by mass, more preferably 0.01% by mass to 0.03% by mass, and further preferably by mass to 0.02% by mass, based on the total amount of the lubricating oil composition, from the standpoint of facilitating the further enhancement of the rust inhibiting capability and the standpoint of achieving the lubricating oil composition excellent in demulsibility.

<Fourth Rust Inhibitor (B4)>

The fourth rust inhibitor (B4) is a combination of a fatty acid having 12 or more carbon atoms (B4-1) and a primary amine (B4-2).

(Fatty Acid Having 12 or More Carbon Atoms (B4-1))

The fourth rust inhibitor (B4) contains a fatty acid having 12 or more carbon atoms (B4-1).

The single use of the fatty acid having 12 or more carbon atoms (B4-1) cannot exert a sufficient rust inhibiting capability to the base oil (A) satisfying the condition (α). However, the combination use thereof with the primary amine (B4-2) exerts an excellent rust inhibiting capability to the base oil (A) satisfying the condition (α).

The fatty acid having 12 or more carbon atoms (B4-1) is not particularly limited, as far as the effects of the present invention can be exerted, and one kind thereof may be used alone, or two or more kinds thereof may be used in combination.

In one embodiment of the present invention, the fatty acid having 12 or more carbon atoms (B4-1) is preferably a fatty acid having 12 to 20 carbon atoms from the standpoint of facilitating the exertion of the effects of the present invention and the standpoint of suppressing the generation of sludge.

Examples of the fatty acid include lauric acid, tridecanoic acid, myristic acid, pentadecanoic acid, palmitic acid, margaric acid, stearic acid, oleic acid, nonadecanoic acid, arachidic acid, eicosenoic acid, henicosylic acid, behenic acid, erucic acid, tricosilyc acid, and lignoceric acid. The aliphatic hydrocarbon group constituting the fatty acid having 12 or more carbon atoms (B4-1) may be a linear group or a branched group.

(Primary Amine (B4-2))

The fourth rust inhibitor (B4) contains a primary amine (B4-2).

The single use of the primary amine (B4-2) cannot exert a sufficient rust inhibiting capability to the base oil (A) satisfying the condition (α). However, the combination use thereof with the fatty acid having 12 or more carbon atoms (B4-1) exerts an excellent rust inhibiting capability to the base oil (A) satisfying the condition (α).

The primary amine (B4-2) is not particularly limited, as far as the effects of the present invention can be exerted, and one kind thereof may be used alone, or two or more kinds thereof may be used in combination.

In one embodiment of the present invention, the primary amine (B4-2) is preferably a primary amine having a hydrocarbon group having 3 to 20 carbon atoms, and more preferably a primary amine having a hydrocarbon group having 6 to 12 carbon atoms, from the standpoint of facilitating the exertion of the effects of the present invention and the standpoint of suppressing the generation of sludge.

Preferred examples of the hydrocarbon group include an alkyl group and an alkenyl group.

Examples of the alkyl group include a hexyl group, a heptyl group, an octyl group, a nonyl group, a decyl group, an undecyl group, and a dodecyl group.

These alkyl groups each may be a linear group or a branched group.

Examples of the alkenyl group include a hexenyl group, a heptenyl group, an octenyl group, a nonenyl group, a decenyl group, an undecenyl group, and a dodecenyl group.

These alkenyl groups each may be a linear group or a branched group.

More specific examples of the primary amine (B4-2) include hexylamine, heptylamine, octylamine, nonylamine, decylamine, undecylamine, dodecylamine, hexenylamine, heptenylamine, octenylamine, nonenylamine, decenylamine, undecenylamine, and dodecenylamine.

(Content of Fourth Rust Inhibitor (B4))

In the case where the lubricating oil composition of the present invention contains the fourth rust inhibitor (B4), the content of the fourth rust inhibitor (B4) is more than 0.05% by mass and less than 0.20% by mass based on the total amount of the lubricating oil composition as defined in the condition (ß).

In the case where the content of the fourth rust inhibitor (B4) is 0.05% by mass or less or 0.20% by mass or more based on the total amount of the lubricating oil composition, a sufficient rust inhibiting capability cannot be exerted to the base oil (A) satisfying the condition (α).

In one embodiment of the present invention, the content of the fourth rust inhibitor (B4) defined in the condition (ß) is preferably 0.06% by mass or more, more preferably 0.08% by mass or more, and further preferably 0.10% by mass or more, based on the total amount of the lubricating oil composition, from the standpoint of facilitating the further enhancement of the rust inhibiting capability and the standpoint of achieving the lubricating oil composition excellent in demulsibility. The content thereof is preferably 0.19% by mass or less, more preferably 0.17% by mass or less, and further preferably 0.15% by mass or less.

The upper limit values and the lower limit values of the numerical ranges may be optionally combined. Specifically, the content thereof is preferably 0.06% by mass to 0.19% by mass, more preferably 0.08% by mass to 0.17% by mass, and further preferably 0.10% by mass to 0.15% by mass.

(Content Ratio of Fatty Acid Having 12 or More Carbon Atoms (B4-1) and Primary Amine (B4-2))

The lubricating oil composition of one embodiment of the present invention preferably has a content ratio [(B4-1)/(B4-2)] of the fatty acid having 12 or more carbon atoms (B4-1) and the primary amine (B4-2) in terms of mass ratio of 0.03 or more and 3.0 or less from the standpoint of facilitating the exertion of the effects of the present invention.

The content ratio [(B4-1)/(B4-2)] is preferably 0.10 or more, more preferably 0.15 or more, and further preferably 0.20 or more, from the standpoint of facilitating the exertion of the effects of the present invention. The content ratio is preferably 2.0 or less, more preferably 1.0 or less, and further preferably 0.40 or less.

The upper limit values and the lower limit values of the numerical ranges may be optionally combined. Specifically, the content ratio is preferably 0.10 to 2.0, more preferably 0.20 to 1.0, and further preferably 0.20 to 0.40.

(Content of Fatty Acid Having 12 or More Carbon Atoms (B4-1))

The lubricating oil composition of one embodiment of the present invention preferably has a content of the fatty acid having 12 or more carbon atoms (B4-1) of by mass or more, more preferably 0.02% by mass or more, and further preferably 0.025% by mass or more, based on the total amount of the lubricating oil composition, from the standpoint of facilitating the exertion of the effects of the present invention. The content thereof is preferably 0.05% by mass or less, more preferably 0.04% by mass or less, and further preferably 0.035% by mass or less.

The upper limit values and the lower limit values of the numerical ranges may be optionally combined. Specifically, the content thereof is preferably more than 0.01% by mass to less than 0.05% by mass, more preferably 0.02% by mass to by mass, and further preferably 0.025% by mass to 0.035% by mass.

(Content of Primary Amine (B4-2))

The lubricating oil composition of one embodiment of the present invention preferably has a content of the primary amine (B4-2) of 0.05% by mass or more, more preferably 0.07% by mass or more, and further preferably 0.09% by mass or more, based on the total amount of the lubricating oil composition, from the standpoint of facilitating the exertion of the effects of the present invention. The content thereof is preferably 0.19% by mass or less, more preferably 0.15% by mass or less, and further preferably 0.11% by mass or less.

The upper limit values and the lower limit values of the numerical ranges may be optionally combined. Specifically, the content thereof is preferably more than 0.05% by mass to less than 0.19% by mass, more preferably 0.07% by mass to by mass, and further preferably 0.09% by mass to 0.11% by mass.

[Rust Inhibitor (B') Other than Rust Inhibitor (B)]

The lubricating oil composition of one embodiment of the present invention may contain a rust inhibitor (B') other than the rust inhibitor (B), but the rust inhibitor (B') cannot exert a sufficient rust inhibiting capability to the base oil (A) satisfying the condition ($\alpha$), and therefore the content of the rust inhibitor (B') is preferably small.

Specifically, the content of the rust inhibitor (B') is preferably less than 0.01% by mass, more preferably 0.008% by mass, and further preferably 0.001% by mass, based on the total amount of the lubricating oil composition, and it is most preferred that the rust inhibitor (B') is not contained.

Examples of the rust inhibitor (B') include a benzotriazole-based compound, an acidic phosphate, an amine salt of an acidic phosphate, a phosphite, an amine salt of a phosphite, a hydrogenphosphite, an amine salt of a hydrogenphosphite, a fatty acid having less than 12 carbon atoms, and a sarcosine derivative.

[Antioxidant (C), Anti-Wear Agent (D), and Anti-Foaming Agent (E)]

The lubricating oil composition of one embodiment of the present invention preferably contains an antioxidant (C) from the standpoint of the enhancement of the oxidation stability.

The lubricating oil composition of one embodiment of the present invention preferably contains an anti-wear agent (D) from the standpoint of the enhancement of the wear resistance.

The lubricating oil composition of one embodiment of the present invention preferably contains an anti-foaming agent (E) from the standpoint of the foaming prevention of the lubricating oil composition.

Accordingly, the lubricating oil composition of one embodiment of the present invention preferably contains one or more kind of an additive selected from the group consisting of an antioxidant (C), an anti-wear agent (D), and an anti-foaming agent (E), more preferably contains two or more kinds of additives selected therefrom, and further preferably contains all the three kinds of additives.

In the lubricating oil composition of one embodiment of the present invention, the total content of the component (A), the component (B), and one or more kind of an additive selected from the group consisting of an antioxidant (C), an anti-wear agent (D), and an anti-foaming agent (E) is preferably 90% by mass to 100% by mass, more preferably 95% by mass to 100% by mass, and further preferably 99% by mass to 100% by mass, based on the total amount of the lubricating oil composition.

<Antioxidant (C)>

The antioxidant (C) used is not particularly limited, as far as the antioxidant has an effect of suppressing oxidation of the lubricating oil composition.

In one embodiment of the present invention, examples thereof include one or more kind selected from the group consisting of a phenol-based antioxidant and an amine-based antioxidant. Among these, a phenol-based antioxidant is preferred.

(Phenol-Based Antioxidant)

The phenol-based antioxidant used is not particularly limited, as far as the compound contains no amino group, has a phenol structure, and has an effect of suppressing oxidation of the lubricating oil composition.

Examples of the phenol-based antioxidant include a monocyclic phenol-based antioxidant and a polycyclic phenol-based antioxidant.

Examples of the monocyclic phenol-based antioxidant include 2,6-di-t-butyl-4-methylphenol, 2,6-di-t-butyl-4-ethylphenol, 2,4,6-tri-t-butylphenol, 2,6-di-t-butyl-4-hydroxymethylphenol, 2,6-di-t-butylphenol, 2,4-dimethyl-6-t-butylphenol, 2,6-di-t-butyl-4 (N, N-dimethylaminomethyl) phenol, 2,6-di-t-amyl-4-methylphenol, and n-octadecyl-3-(3,5-di-t-butyl-4-hydroxyphenyl) propionate.

Examples of the polycyclic phenol-based antioxidant include 4,4'-methylenebis(2,6-di-t-butylphenol), 4,4' isopropylidenebis(2,6-di-t-butylphenol), 2,2'-methylenebis(4-methyl-6-t-butylphenol), 4,4'-bis(2,6-di-t-butylphenol), 4,4'-bis(2-methyl-6-t-butylphenol), 2,2'-methylenebis(4-ethyl-6-t-butylphenol), and 4,4'-butylidenebis(3-methyl-6-t-butylphenol).

(Amine-Based Antioxidant)

The amine-based antioxidant (B) used is not particularly limited, as far as the compound has ammonia ($NH_3$), at least one hydrogen atom of which is substituted by a hydrocarbon group, and has an effect of suppressing oxidation of the lubricating oil composition.

Examples of the amine-based antioxidant include a diphenylamine compound and a naphthylamine compound.

Examples of the diphenylamine compound include a monoalkyldiphenylamine-based compound, such as monooctyldiphenylamine and monononyldiphenylamine; a dialkyldiphenylamine-based compound, such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine, and 4,4'-dinonyldiphenylamine; a polyalkyldiphenylamine-based compound, such as tetrabutyldiphenylamine, tetrahexyldiphenylamine, tetraoctyldiphenylamine, and tetranonyldiphenylamine; 4,4'-bis($\alpha$,$\alpha$-dimethylbenzyl)diphenylamine.

Examples of the naphthylamine-based compound include 1-naphthylamine, phenyl-1-naphthylamine, butylphenyl-1-naphthylamine, pentylphenyl-1-naphthylamine, hexylphenyl-1-naphthylamine, heptylphenyl-1-naphthylamine, octylphenyl-1-naphthylamine, nonylphenyl-1-naphthylamine, decylphenyl-1-naphthylamine, and dodecylphenyl-1-naphthylamine.

(Content of Antioxidant (C))

In one embodiment of the present invention, the content of the antioxidant (C) is appropriately regulated to a range that is capable of exerting an effect of suppressing oxidation of the lubricating oil composition.

Specifically, the content of the antioxidant (C) is preferably 0.3% by mass to 1.0% by mass, more preferably 0.4% by mass to 0.8% by mass, and further preferably 0.5% by mass to 0.7% by mass, based on the total amount of the lubricating oil composition.

<Anti-Wear Agent (D)>

The anti-wear agent (D) used is not particularly limited, as far as the compound has an effect of enhancing the wear resistance.

In one embodiment of the present invention, examples of the anti-wear agent (D) include a neutral aromatic phosphate represented by the following general formula (d-1).

(d-1)

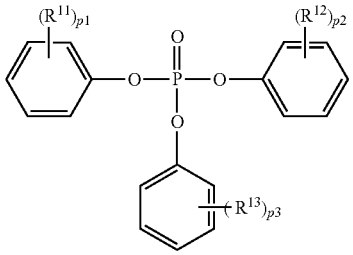

In the general formula (d-1), $R^{11}$ to $R^{13}$ each independently represent an alkyl group having 1 to 12 carbon atoms. Examples of the alkyl group include the same groups as exemplified as the alkyl groups capable of being selected as $R^1$ to $R^3$ in the general formula (b3-1) for the neutral alkyl phosphate (B3-1), and a methyl group and an ethyl group.

The number of carbon atoms of the alkyl group capable of being selected as $R^{11}$ to $R^{13}$ is 1 to 12, and is preferably 1 to 10, more preferably 1 to 8, further preferably 1 to 6, still further preferably 1 to 3, and still more further preferably 1.

p1 to p3 each independently represent an integer of 1 to 5, preferably an integer of 1 to 2, and further preferably 1.

The neutral aromatic phosphate represented by the general formula (d-1) has a molecular skeleton that is similar to the neutral alkyl phosphate used as the rust inhibitor (B3), but cannot exert a sufficient rust inhibiting capability to the base oil (A) satisfying the condition (α). Accordingly, the neutral alkyl phosphate and the neutral aromatic phosphate are encompassed in orthophosphate, but for exerting a sufficient rust inhibiting capability to the base oil (A) satisfying the condition (α), it is important to use an orthophosphate having an alkyl group as a substituent, but not an aromatic group.

(Content of Anti-Wear Agent (D))

In one embodiment of the present invention, the content of the anti-wear agent (D) is appropriately regulated to a range that is capable of exerting an effect of enhancing the wear resistance.

Specifically, the content of the anti-wear agent (D) is preferably 0.1% by mass to 0.7% by mass, more preferably 0.2% by mass to 0.6% by mass, and further preferably 0.3% by mass to 0.5% by mass, based on the total amount of the lubricating oil composition.

<Anti-Foaming Agent (E)>

The anti-foaming agent (E) used is not particularly limited, as far as the compound exerts an effect of suppressing foaming of the lubricating oil composition.

In one embodiment of the present invention, examples of the anti-foaming agent (E) include a silicone-based anti-foaming agent, a fluorine-based anti-foaming agent, such as a fluorosilicone oil and a fluoroalkyl ether, and a polyacrylate-based anti-foaming agent.

In one embodiment of the present invention, the content of the anti-foaming agent (E) in terms of resin content is preferably 0.0001% by mass to 0.20% by mass, and more preferably 0.0005% by mass to 0.10% by mass, based on the total amount of the lubricating oil composition.

<Additional Lubricating Oil Additive>

The lubricating oil composition of one embodiment of the present invention may contain an additional lubricating oil additive other than the rust inhibitor (B), the antioxidant (C), the anti-wear agent (D), and the anti-foaming agent (E), in such a range that does not impair the effects of the present invention.

Examples of the additional lubricating oil additive include an extreme pressure agent, a friction modifier, and a metal deactivator.

One kind of these additional lubricating oil additives may be used alone, or two or more kinds thereof may be used in combination.

[Properties of Lubricating Oil Composition]

<100° C. Kinematic Viscosity and Viscosity Index of Lubricating Oil Composition>

The 100° C. kinematic viscosity of the lubricating oil composition of one embodiment of the present invention is preferably 5.0 $mm^2/s$ to 10.0 $mm^2/s$, more preferably 6.0 $mm^2/s$ to 9.0 $mm^2/s$, and further preferably 6.4 $mm^2/s$ to 8.6 $mm^2/s$.

The viscosity index of the lubricating oil composition of one embodiment of the present invention is preferably 100 or more, more preferably 110 or more, and further preferably 120 or more.

In the description herein, the 100° C. kinematic viscosity and the viscosity index of the lubricating oil composition are values that are measured or calculated according to JIS K2283:2000.

<Flash Point of Lubricating Oil Composition>

The lubricating oil composition of one embodiment of the present invention preferably has a flash point of 250° C. or more from the standpoint of the safety and the handleability in storage and transportation.

In the description herein, the flash point of the lubricating oil composition is a value that is measured according to JIS K2265-4:2007 (Determination of flash points, Part 4: Cleveland open cup method) by the Cleveland open-cup method.

<Rust Inhibiting Capability>

The lubricating oil composition of one embodiment of the present invention preferably causes no rust in a test according to JIS K2510:1998 (Method B, artificial seawater method) shown in Examples described later.

<Demulsibility>

The lubricating oil composition of one embodiment of the present invention has, in the water separability test according to JIS K2520:2000 shown in Examples described later, a period of time required for separation of preferably 20 minutes or less, more preferably 15 minutes or less, and further preferably 10 minutes or less.

[Method for Producing Lubricating Oil Composition]

The production method of the lubricating oil composition of the present invention is not particularly limited.

For example, the production method of the lubricating oil composition of one embodiment of the present invention may be a method for producing a lubricating oil composition, including mixing a base oil (A) and a rust inhibitor (B), the base oil (A) satisfying the following condition (α):

<Condition (α)> a gas chromatogram measured according to ASTM D7500 with a gas chromatography distillation equipment having a peak in a range of a number of carbon atoms of more than 11 and less than 23, the rust inhibitor (B) being one or more kind selected from the group consisting of a first rust inhibitor (B1), a second rust inhibitor (B2), a third rust inhibitor (B3), and a fourth rust inhibitor (B4):

the first rust inhibitor (B1): a combination of a succinate (B1-1) and a sorbitan fatty acid ester (B1-2), the second rust inhibitor (B2): a carboxylic acid amide (B2-1), the third rust inhibitor (B3): a neutral alkyl phosphate (B3-1), and the fourth rust inhibitor (B4): a combination of a fatty acid having 12 or more carbon atoms (B4-1) and a primary amine (B4-2), blending amounts of the first rust inhibitor (B1), the second rust inhibitor (B2), the third rust inhibitor (B3), and the fourth rust inhibitor (B4) satisfying the following condition (ß) based on the total amount of the lubricating oil composition:

<Condition (B)> the first rust inhibitor (B1): more than 0.02% by mass and less than 0.16% by mass, the second rust inhibitor (B2): more than 0.05% by mass and 0.5% by mass or less, the third rust inhibitor (B3): 0.005% by mass or more and less than 0.05% by mass, and the fourth rust inhibitor (B4): more than 0.05% by mass and less than 0.20% by mass.

The method of mixing the components is not particularly limited, and examples thereof include a method including a step of blending the base oil (A) and the rust inhibitor (B). In the case where one or more kind selected from the group consisting of the antioxidant (C), the anti-wear agent (D), and the anti-foaming agent (E) is further blended, these materials may be blended simultaneously with the rust inhibitor (B), or may be separately therefrom. The same is applied to the blending of the additional lubricating oil additives. The components each may be blended in the form of a solution (or dispersion) obtained by adding a diluent oil or the like. After blending the components, the components are preferably dispersed uniformly by agitating according to a known method.

[Applications of Lubricating Oil Composition]

The lubricating oil composition of one embodiment of the present invention can be favorably applied to a lubricating oil composition used in equipments that may be contaminated with water or steam.

Examples of the equipments that may be contaminated with water or steam include a turbine equipment, such as a steam turbine. The lubricating oil composition of one embodiment of the present invention can be favorably applied to a turbine oil used for lubricating a turbine equipment.

According to the lubricating oil composition of the present invention, a use method including using the lubricating oil composition in a turbine equipment is also provided.

In the case where the lubricating oil composition of one embodiment of the present invention is applied to a steam turbine, the antioxidant (C) blended in the lubricating oil composition is preferably a phenol-based antioxidant, and the content of the amine-based antioxidant is preferably small. Specifically, the content of the amine-based antioxidant is preferably less than 0.1% by mass, and more preferably 0.01% by mass, based on the total amount of the lubricating oil composition, and it is most preferred that the amine-based antioxidant is not contained.

One Embodiment Provided by Present Invention

According to one embodiment of the present invention, the following items [1] to [9] are provided.

[1] A lubricating oil composition containing a base oil (A) and a rust inhibitor (B), the base oil (A) satisfying the following condition (α):

<Condition (α)> a gas chromatogram measured according to ASTM D7500 with a gas chromatography distillation equipment having a peak in a range of a number of carbon atoms of more than 11 and less than 23, the rust inhibitor (B) being one or more kind selected from the group consisting of a first rust inhibitor (B1), a second rust inhibitor (B2), a third rust inhibitor (B3), and a fourth rust inhibitor (B4):

the first rust inhibitor (B1): a combination of a succinate (B1-1) and a sorbitan fatty acid ester (B1-2), the second rust inhibitor (B2): a carboxylic acid amide (B2-1), the third rust inhibitor (B3): a neutral alkyl phosphate (B3-1), and the fourth rust inhibitor (B4): a combination of a fatty acid having 12 or more carbon atoms (B4-1) and a primary amine (B4-2), having contents of the first rust inhibitor (B1), the second rust inhibitor (B2), the third rust inhibitor (B3), and the fourth rust inhibitor (B4) satisfying the following condition (ß) based on the total amount of the lubricating oil composition:

<Condition (ß)> the first rust inhibitor (B1): more than 0.02% by mass and less than 0.16% by mass, the second rust inhibitor (B2): more than 0.05% by mass and 0.5% by mass or less, the third rust inhibitor (B3): 0.005% by mass or more and less than 0.05% by mass, and the fourth rust inhibitor (B4): more than 0.05% by mass and less than 0.20% by mass.

[2] The lubricating oil composition according to the item [1], wherein in the first rust inhibitor (B1), the succinate (B1-1) contains a polyhydric alcohol alkenylsuccinate.

[3] The lubricating oil composition according to the item [1] or [2], wherein in the first rust inhibitor (B1), the sorbitan fatty acid ester (B1-2) contains an ester compound of sorbitan and a fatty acid having 12 or more and 30 or less carbon atoms.

[4] The lubricating oil composition according to any one of the items [1] to [3], wherein in the second rust inhibitor (B2), the carboxylic acid amide (B2-1) has an acid value of 80 mgKOH/g or less.

[5] The lubricating oil composition according to any one of the items [1] to [4], wherein the base oil (A) further satisfies the following condition (Y):

<Condition (γ)> a flash point by Cleveland open cup method: 250° C. or more, a density at 15° C.: 0.8300 g/cm$^3$ or less, a viscosity index of 100 or more, and a 100° C. kinematic viscosity: 7.50 mm$^2$/s or more and 9.00 mm$^2$/s or less.

[6] The lubricating oil composition according to any one of the items [1] to [5], wherein the lubricating oil composition further contains one or more kind of an additive selected from the group consisting of an antioxidant (C), an anti-wear agent (D), and an anti-foaming agent (E).

[7] The lubricating oil composition according to any one of the items [1] to [6], wherein the lubricating oil composition is used as a turbine oil.

[8] A method for using a lubricating oil composition, including using the lubricating oil composition according to any one of the items [1] to [7] as a turbine oil

[9] A method for producing a lubricating oil composition, including mixing a base oil (A) and a rust inhibitor (B), the base oil (A) satisfying the following condition (α):

<Condition (α)> a gas chromatogram measured according to ASTM D7500 with a gas chromatography distillation equipment having a peak in a range of a number of carbon atoms of more than 11 and less than 23, the rust inhibitor (B) being one or more kind selected from the group consisting of a first rust inhibitor (B1), a second rust inhibitor (B2), a third rust inhibitor (B3), and a fourth rust inhibitor (B4):

the first rust inhibitor (B1): a combination of a succinate (B1-1) and a sorbitan fatty acid ester (B1-2), the second rust inhibitor (B2): a carboxylic acid amide (B2-1), the third rust inhibitor (B3): a neutral alkyl phosphate (B3-1), and the fourth rust inhibitor (B4): a combination of a fatty acid having 12 or more carbon atoms (B4-1) and a primary amine (B4-2), blending amounts of the first rust inhibitor (B1), the second rust inhibitor (B2), the third rust inhibitor (B3), and the fourth rust inhibitor (B4) satisfying the following condition (ß) based on the total amount of the lubricating oil composition:

<Condition (ß)> the first rust inhibitor (B1): more than 0.02% by mass and less than 0.16% by mass, the second rust inhibitor (B2): more than 0.05% by mass and 0.5% by mass or less, the third rust inhibitor (B3): 0.005% by mass or more and less than 0.05% by mass, and the fourth rust inhibitor (B4): more than 0.05% by mass and less than 0.20% by mass.

EXAMPLES

The present invention will be described more specifically with reference to examples below, but the present invention is not limited to the examples.

[Measurement Methods of Property Values]

The properties of the raw materials used in Examples and Comparative Examples and the lubricating oil compositions of Examples and Comparative Examples were measured according to the following procedures.

(1) Kinematic Viscosity and Viscosity Index

The values were measured or calculated according to JIS K2283:2000.

(2) Flash Point

The value was measured according to JIS K2265-4: 2007 (Determination of flash points, Part 4: Cleveland open cup method) by the Cleveland open-cup method.

(3) Density at 15° C.

The value was measured according to JIS K2249-1: 2011 (Crude petroleum and petroleum products-Determination of density-Part 1: Oscillating U-tube method).

(4) Acid Value

The value was measured according to JIS K2501: 2003-5 (indicator titration method).

Examples 1 to 5, Comparative Examples 1 to 24, and Reference Example 1

The base oils and the additives shown below were sufficiently mixed at the blending amounts (% by mass) shown in Tables 1 to 7 to prepare lubricating oil compositions.

The details of the base oils and the additives used in Examples 1 to 5, Comparative Examples 1 to 24, and Reference Example 1 are as follows.

<Base Oil (A)>

A base oil having the following property values was used.

Flash point: 257° C.

Density at 15° C.: 0.8254 g/cm$^3$

100° C. kinematic viscosity: 7.527 mm$^2$/s

Viscosity index: 120

<Base Oil (A')>

A mineral oil having the following property values was used.

Flash point: 256° C.

Density at 15° C.: 0.8440 g/cm$^3$

100° C. kinematic viscosity: 7.340 mm$^2$/s

Viscosity index: 118

<Rust Inhibitor (B)>

(First Rust Inhibitor (B1))

"Succinate (B1-1)": polyhydric alcohol alkenylsuccinate

"Sorbitan fatty acid ester (B1-2)": sorbitan monooleate (Second Rust Inhibitor (B2))

"Carboxylic acid amide (B2-1)": carboxylic acid amide having acid value of mgKOH/g (carboxylic acid amide formed of 3-dodecenyldihydro-2,5-furandione and triethylenetetramine)

(Third Rust Inhibitor (B3))

"Fatty acid phosphate (B3)": alkylphosphate (number of carbon atoms: 12) (Fourth Rust Inhibitor (B4))

"Fatty acid having 12 or more carbon atoms (B4-1)": lauric acid

"Primary amine (B4-2)": octylamine (Rust Inhibitor (B'))

"Sarcosine derivative": N-alkylsarcosine

"Benzotriazole-based compound": dialkylaminomethylbenzotriazole

"Phosphorus-based compound 1": mixture of acid phosphate amine salt and phosphite amine salt "Phosphorus-based compound 2": dioleoyl hydrogenphosphite "Fatty acid having less than 12 carbon atoms 1": caprylic acid "Fatty acid having less than 12 carbon atoms 2": capric acid (Antioxidant (C))

Phenol-based antioxidant (Anti-Wear Agent (D))

Tricresyl phosphate (Anti-Foaming Agent (E))

Silicone-based anti-foaming agent

The contents of the silicone-based anti-foaming agent shown in Tables 1 to 7 each are the content including the diluent oil, and the content of the silicone-based anti-foaming agent in terms of resin content is 0.001% by mass based on the total amount of the lubricating oil composition.

[Evaluation]

(1) Evaluation of Base Oil

The base oil (A) and the base oil (A') each were measured for gas chromatogram through gas chromatography distillation under the following condition.

(Measurement Condition)

Measurement device: gas chromatography distillation equipment, produced by Analytical Controls Gas chromatography standard: ASTM D7500

Column: wide pore metal column "Simdis HT/CNS", produced by PAC (column liquid phase: dimethylpolysiloxane, column length: 5.0 m×column inner diameter: 0.53 mm×liquid phase thickness: 0.17 μm)

Carrier gas: helium (flow rate: 23 mL/min)

Inlet temperature: initial temperature: 100° C., increased to 430° C. at heating rate of 15° C./min and retained for 22 minutes Column oven temperature: initial temperature: 40° C., increased to 430° C. at heating rate of 10° C./min and retained for 5 minutes Total measurement time: 44 min/specimen FID temperature: 430° C.

(2) Evaluation of Rust Inhibiting Capability

The lubricating oil compositions of Examples 1 to 5, Comparative Examples 1 to 24, and Reference Example 1 each were confirmed for the state of rust under conditions of 60° C. and 24 hours according to JIS K2510:1998 (Method B, artificial seawater method). In the examples, a specimen with no occurrence of rust found was evaluated as "pass (A)", and a specimen with occurrence of rust found was evaluated as "fail (F)".

(3) Evaluation of Demulsibility

The lubricating oil compositions of Examples 1 to 5 each were subjected to the water separability test according to JIS K2520:2000.

Specifically, 40 mL of the lubricating oil composition and 40 mL of pure water were placed in a test tube and mixed at 1,500 rpm with an agitation plate for 5 minutes while retaining the liquid temperature at 54° C., and then the period of time until the resulting emulsion was separated into water and the oil was measured.

In Table 7, the evaluation result of the demulsibility (a-b-c(d)) means the following.

a: Capacity of oil phase (unit: mL)

b: Capacity of water phase (unit: mL)

c: Capacity of emulsion phase (unit: mL)

d: Period of time required for separation (unit: min)

In the evaluation result of the demulsibility, a value a closer to 40 mL, a value b closer to 40 mL, a value c closer to 0 mL, and a shorter value d mean an excellent demulsibility.

In the "(1) Evaluation of Base Oil", the gas chromatograms of the base oil (A) and the base oil (A') measured by gas chromatography are shown in FIG. 1.

The results of the "(2) Evaluation of Rust Inhibiting Capability" are shown in Tables 1 to 6.

The results of the "(3) Evaluation of Demulsibility" are shown in Table 7.

TABLE 1

| | | | | Reference Example | Comparative Example | |
|---|---|---|---|---|---|---|
| | | | | 1 | 1 | 24 |
| Composition of lubricating oil composition (unit: % by mass) | Base oil (A): base oil satisfying condition (α) | | | | 98.85 | 98.83 |
| | Base oil (A'): base oil not satisfying condition (α) | | | 98.85 | | |
| | Rust inhibitor (B) | First rust inhibitor (B1) | Succinate (B1-1) | 0.05 | 0.05 | 0.03 |
| | | | Sorbitan fatty acid ester (B1-2) | | | |
| | | Second rust inhibitor (B2) | Carboxylic acid amide (B2-1) | | | |
| | | Third rust inhibitor (B3) | Neutral alkyl phosphate (B3-1) | | | |
| | | Fourth rust inhibitor (B4) | Fatty acid having 12 or more carbon atoms (B4-1) | | | |
| | | | Primary amine (B4-2) | | | |
| | Rust inhibitor (B') | Benzotriazole-based compound | | | | |
| | | Phosphorus-based compound 1 | | | | |
| | | Phosphorus-based compound 2 | | | | |
| | | Fatty acid having less than 12 carbon atoms 1 | | | | |
| | | Fatty acid having less than 12 carbon atoms 2 | | | | |
| | | Sarcosine derivative | | | | 0.04 |
| | Antioxidant (C) | Phenol-based antioxidant | | 0.6 | 0.6 | 0.6 |
| | Anti-wear agent (D) | Tricresyl phosphate | | 0.4 | 0.4 | 0.4 |
| | Anti-foaming agent (E) | Silicone-based anti-foaming agent | | 0.1 | 0.1 | 0.1 |
| | Total content | | | 100.00 | 100.00 | 100.00 |
| Properties and calculated values | 100° C. Kinematic viscosity of lubricating oil composition (unit: $mm^2/s$) | | | 6.57 | 7.53 | 7.53 |
| | Total amount of the first rust inhibitor (B1) (unit: % by mass, based on total amount of lubricating oil composition) | | | 0.05 | 0.05 | 0.03 |
| | Total amount of the fourth rust inhibitor (B4) (unit: % by mass, based on total amount of lubricating oil composition) | | | — | — | — |
| | [(B1-1)/(B1-2)] (mass ratio) | | | — | — | — |
| | [(B4-1)/(B4-2)] (mass ratio) | | | — | — | — |
| Evaluation results | Rust inhibiting capability | Occurrence of rust | | A | F | F |

TABLE 2

| | | | | Example | Comparative Example | | |
|---|---|---|---|---|---|---|---|
| | | | | 1 | 1 | 2 | 3 |
| Composition of lubricating oil composition (unit: % by mass) | Base oil (A): base oil satisfying condition (α) | | | 98.80 | 98.85 | 98.82 | 98.80 |
| | Base oil (A'): base oil not satisfying condition (α) | | | | | | |
| | Rust inhibitor (B) | First rust inhibitor (B1) | Succinate (B1-1) | 0.05 | 0.05 | 0.08 | 0.10 |
| | | | Sorbitan fatty acid ester (B1-2) | 0.05 | | | |
| | | Second rust inhibitor (B2) | Carboxylic acid amide (B2-1) | | | | |
| | | Third rust inhibitor (B3) | Neutral alkyl phosphate (B3-1) | | | | |
| | | Fourth rust inhibitor (B4) | Fatty acid having 12 or more carbon atoms (B4-1) | | | | |
| | | | Primary amine (B4-2) | | | | |
| | Rust inhibitor (B') | Benzotriazole-based compound | | | | | |
| | | Phosphorus-based compound 1 | | | | | |
| | | Phosphorus-based compound 2 | | | | | |
| | | Fatty acid having less than 12 carbon atoms 1 | | | | | |
| | | Fatty acid having less than 12 carbon atoms 2 | | | | | |
| | | Sarcosine derivative | | | | | |
| | Antioxidant (C) | Phenol-based antioxidant | | 0.6 | 0.6 | 0.6 | 0.6 |
| | Anti-wear agent (D) | Tricresyl phosphate | | 0.4 | 0.4 | 0.4 | 0.4 |
| | Anti-foaming agent (E) | Silicone-based anti-foaming agent | | 0.1 | 0.1 | 0.1 | 0.1 |
| | Total content | | | 100.00 | 100.00 | 100.00 | 100.00 |
| Properties and calculated values | 100° C. Kinematic viscosity of lubricating oil composition (unit: $mm^2/s$) | | | 7.53 | 7.53 | 7.53 | 7.53 |
| | Total amount of the first rust inhibitor (B1) (unit: % by mass, based on total amount of lubricating oil composition) | | | 0.10 | 0.05 | 0.08 | 0.10 |
| | Total amount of the fourth rust inhibitor (B4) (unit: % by mass, based on total amount of lubricating oil composition) | | | — | — | — | — |
| | [(B1-1)/(B1-2)] (mass ratio) | | | 1.00 | — | — | — |
| | [(B4-1)/(B4-2)] (mass ratio) | | | — | — | — | — |
| Evaluation results | Rust inhibiting capability | Occurrence of rust | | A | F | F | F |

| | | | | Comparative Example | | | |
|---|---|---|---|---|---|---|---|
| | | | | 4 | 5 | 6 | 7 |
| Composition of lubricating oil composition (unit: % by mass) | Base oil (A): base oil satisfying condition (α) | | | 98.85 | 98.82 | 98.88 | 98.74 |
| | Base oil (A'): base oil not satisfying condition (α) | | | | | | |
| | Rust inhibitor (B) | First rust inhibitor (B1) | Succinate (B1-1) | | | 0.01 | 0.08 |
| | | | Sorbitan fatty acid ester (B1-2) | 0.05 | 0.08 | 0.01 | 0.08 |
| | | Second rust inhibitor (B2) | Carboxylic acid amide (B2-1) | | | | |
| | | Third rust inhibitor (B3) | Neutral alkyl phosphate (B3-1) | | | | |
| | | Fourth rust inhibitor (B4) | Fatty acid having 12 or more carbon atoms (B4-1) | | | | |
| | | | Primary amine (B4-2) | | | | |
| | Rust inhibitor (B') | Benzotriazole-based compound | | | | | |
| | | Phosphorus-based compound 1 | | | | | |
| | | Phosphorus-based compound 2 | | | | | |
| | | Fatty acid having less than 12 carbon atoms 1 | | | | | |
| | | Fatty acid having less than 12 carbon atoms 2 | | | | | |
| | | Sarcosine derivative | | | | | |
| | Antioxidant (C) | Phenol-based antioxidant | | 0.6 | 0.6 | 0.6 | 0.6 |
| | Anti-wear agent (D) | Tricresyl phosphate | | 0.4 | 0.4 | 0.4 | 0.4 |
| | Anti-foaming agent (E) | Silicone-based anti-foaming agent | | 0.1 | 0.1 | 0.1 | 0.1 |
| | Total content | | | 100.00 | 100.00 | 100.00 | 100.00 |
| Properties and calculated values | 100° C. Kinematic viscosity of lubricating oil composition (unit: $mm^2/s$) | | | 7.53 | 7.53 | 7.53 | 7.54 |
| | Total amount of the first rust inhibitor (B1) (unit: % by mass, based on total amount of lubricating oil composition) | | | 0.05 | 0.08 | 0.02 | 0.16 |
| | Total amount of the fourth rust inhibitor (B4) (unit: % by mass, based on total amount of lubricating oil composition) | | | — | — | — | — |
| | [(B1-1)/(B1-2)] (mass ratio) | | | 0.00 | 0.00 | 1.00 | 1.00 |
| | [(B4-1)/(B4-2)] (mass ratio) | | | — | — | — | — |
| Evaluation results | Rust inhibiting capability | Occurrence of rust | | F | F | F | F |

TABLE 3

| | | | | Comparative Example | | | |
|---|---|---|---|---|---|---|---|
| | | | | 8 | 9 | 10 | 11 |
| Composition of lubricating oil composition (unit: % by mass) | Base oil (A): base oil satisfying condition (α) | | | 98.85 | 98.80 | 98.80 | 98.83 |
| | Base oil (A'): base oil not satisfying condition (α) | | | | | | |
| | Rust inhibitor (B) | First rust inhibitor (B1) | Succinate (B1-1) | | 0.05 | | 0.05 |
| | | | Sorbitan fatty acid ester (B1-2) | | | 0.05 | |
| | | Second rust inhibitor (B2) | Carboxylic acid amide (B2-1) | | | | |
| | | Third rust inhibitor (B3) | Neutral alkyl phosphate (B3-1) | | | | |
| | | Fourth rust inhibitor (B4) | Fatty acid having 12 or more carbon atoms (B4-1) | | | | |
| | | | Primary amine (B4-2) | | | | |
| | Rust inhibitor (B') | Benzotriazole-based compound | | 0.05 | 0.05 | 0.05 | 0.02 |
| | | Phosphorus-based compound 1 | | | | | |
| | | Phosphorus-based compound 2 | | | | | |
| | | Fatty acid having less than 12 carbon atoms 1 | | | | | |
| | | Fatty acid having less than 12 carbon atoms 2 | | | | | |
| | | Sarcosine derivative | | | | | |
| | Antioxidant (C) | Phenol-based antioxidant | | 0.6 | 0.6 | 0.6 | 0.6 |
| | Anti-wear agent (D) | Tricresyl phosphate | | 0.4 | 0.4 | 0.4 | 0.4 |
| | Anti-foaming agent (E) | Silicone-based anti-foaming agent | | 0.1 | 0.1 | 0.1 | 0.1 |
| | Total content | | | 100.00 | 100.00 | 100.00 | 100.00 |
| Properties and calculated values | 100° C. Kinematic viscosity of lubricating oil composition (unit: $mm^2/s$) | | | 7.53 | 7.53 | 7.53 | 7.53 |
| | Total amount of the first rust inhibitor (B1) (unit: % by mass, based on total amount of lubricating oil composition) | | | 0.05 | 0.10 | 0.10 | 0.07 |
| | Total amount of the fourth rust inhibitor (B4) (unit: % by mass, based on total amount of lubricating oil composition) | | | — | — | — | — |
| | [(B1-1)/(B1-2)] (mass ratio) | | | — | — | 0.00 | — |
| | [(B4-1)/(B4-2)] (mass ratio) | | | — | — | — | — |
| Evaluation results | Rust inhibiting capability | Occurrence of rust | | F | F | F | F |

| | | | | Comparative Example | | |
|---|---|---|---|---|---|---|
| | | | | 12 | 13 | 14 |
| Composition of lubricating oil composition (unit: % by mass) | Base oil (A): base oil satisfying condition (α) | | | 98.80 | 98.78 | 98.77 |
| | Base oil (A'): base oil not satisfying condition (α) | | | | | |
| | Rust inhibitor (B) | First rust inhibitor (B1) | Succinate (B1-1) | 0.08 | 0.10 | 0.08 |
| | | | Sorbitan fatty acid ester (B1-2) | | | |
| | | Second rust inhibitor (B2) | Carboxylic acid amide (B2-1) | | | |
| | | Third rust inhibitor (B3) | Neutral alkyl phosphate (B3-1) | | | |
| | | Fourth rust inhibitor (B4) | Fatty acid having 12 or more carbon atoms (B4-1) | | | |
| | | | Primary amine (B4-2) | | | |
| | Rust inhibitor (B') | Benzotriazole-based compound | | 0.02 | 0.02 | 0.05 |
| | | Phosphorus-based compound 1 | | | | |
| | | Phosphorus-based compound 2 | | | | |
| | | Fatty acid having less than 12 carbon atoms 1 | | | | |
| | | Fatty acid having less than 12 carbon atoms 2 | | | | |
| | | Sarcosine derivative | | | | |
| | Antioxidant (C) | Phenol-based antioxidant | | 0.6 | 0.6 | 0.6 |
| | Anti-wear agent (D) | Tricresyl phosphate | | 0.4 | 0.4 | 0.4 |
| | Anti-foaming agent (E) | Silicone-based anti-foaming agent | | 0.1 | 0.1 | 0.1 |
| | Total content | | | 100.00 | 100.00 | 100.00 |
| Properties and calculated values | 100° C. Kinematic viscosity of lubricating oil composition (unit: $mm^2/s$) | | | 7.54 | 7.53 | 7.53 |
| | Total amount of the first rust inhibitor (B1) (unit: % by mass, based on total amount of lubricating oil composition) | | | 0.10 | 0.12 | 0.13 |
| | Total amount of the fourth rust inhibitor (B4) (unit: % by mass, based on total amount of lubricating oil composition) | | | — | — | — |
| | [(B1-1)/(B1-2)] (mass ratio) | | | — | — | — |
| | [(B4-1)/(B4-2)] (mass ratio) | | | — | — | — |
| Evaluation results | Rust inhibiting capability | Occurrence of rust | | F | F | F |

TABLE 4

| | | | | Example | | Comparative Example |
|---|---|---|---|---|---|---|
| | | | | 2 | 3 | 15 |
| Composition of lubricating oil composition (unit: % by mass) | Base oil (A): base oil satisfying condition (α) | | | 98.80 | 98.70 | 98.85 |
| | Base oil (A'): base oil not satisfying condition (α) | | | | | |
| | Rust inhibitor (B) | First rust inhibitor (B1) | Succinate (B1-1) | | | |
| | | | Sorbitan fatty acid ester (B1-2) | | | |
| | | Second rust inhibitor (B2) | Carboxylic acid amide (B2-1) | 0.10 | 0.20 | 0.05 |
| | | Third rust inhibitor (B3) | Neutral alkyl phosphate (B3-1) | | | |
| | | Fourth rust inhibitor (B4) | Fatty acid having 12 or more carbon atoms (B4-1) | | | |
| | | | Primary amine (B4-2) | | | |
| | Rust inhibitor (B') | Benzotriazole-based compound | | | | |
| | | Phosphorus-based compound 1 | | | | |
| | | Phosphorus-based compound 2 | | | | |
| | | Fatty acid having less than 12 carbon atoms 1 | | | | |
| | | Fatty acid having less than 12 carbon atoms 2 | | | | |
| | | Sarcosine derivative | | | | |
| | Antioxidant (C) | Phenol-based antioxidant | | 0.6 | 0.6 | 0.6 |
| | Anti-wear agent (D) | Tricresyl phosphate | | 0.4 | 0.4 | 0.4 |
| | Anti-foaming agent (E) | Silicone-based anti-foaming agent | | 0.1 | 0.1 | 0.1 |
| | Total content | | | 100.00 | 100.00 | 100.00 |
| Properties and calculated values | 100° C. Kinematic viscosity of lubricating oil composition (unit: $mm^2/s$) | | | 7.53 | 7.54 | 7.53 |
| | Total amount of the first rust inhibitor (B1) (unit: % by mass, based on total amount of lubricating oil composition) | | | — | — | — |
| | Total amount of the fourth rust inhibitor (B4) (unit: % by mass, based on total amount of lubricating oil composition) | | | — | — | — |
| | [(B1-1)/(B1-2)] (mass ratio) | | | — | — | — |
| | [(B4-1)/(B4-2)] (mass ratio) | | | — | — | — |
| Evaluation results | Rust inhibiting capability | Occurrence of rust | | A | A | F |

TABLE 5

| | | | | Example | Comparative Example | | | |
|---|---|---|---|---|---|---|---|---|
| | | | | 4 | 16 | 17 | 18 | 19 |
| Composition of lubricating oil composition (unit: % by mass) | Base oil (A): base oil satisfying condition (α) | | | 98.89 | 98.85 | 98.80 | 98.80 | 98.85 |
| | Base oil (A'): base oil not satisfying condition (α) | | | | | | | |
| | Rust inhibitor (B) | First rust inhibitor (B1) | Succinate (B1-1) | | | | | |
| | | | Sorbitan fatty acid ester (B1-2) | | | | | |
| | | Second rust inhibitor (B2) | Carboxylic acid amide (B2-1) | | | | | |
| | | Third rust inhibitor (B3) | Neutral alkyl phosphate (B3-1) | 0.01 | 0.05 | 0.10 | | |
| | | Fourth rust inhibitor (B4) | Fatty acid having 12 or more carbon atoms (B4-1) | | | | | |
| | | | Primary amine (B4-2) | | | | | |
| | Rust inhibitor (B') | Benzotriazole-based compound | | | | | | |
| | | Phosphorus-based compound 1 | | | | | 0.1 | |
| | | Phosphorus-based compound 2 | | | | | | 0.05 |
| | | Fatty acid having less than 12 carbon atoms 1 | | | | | | |
| | | Fatty acid having less than 12 carbon atoms 2 | | | | | | |
| | | Sarcosine derivative | | | | | | |
| | Antioxidant (C) | Phenol-based antioxidant | | 0.6 | 0.6 | 0.6 | 0.6 | 0.6 |

TABLE 5-continued

| | | | Example | Comparative Example | | | |
|---|---|---|---|---|---|---|---|
| | | | 4 | 16 | 17 | 18 | 19 |
| | Anti-wear agent (D) | Tricresyl phosphate | 0.4 | 0.4 | 0.4 | 0.4 | 0.4 |
| | Anti-foaming agent (E) | Silicone-based anti-foaming agent | 0.1 | 0.1 | 0.1 | 0.1 | 0.1 |
| | Total content | | 100.00 | 100.00 | 100.00 | 100.00 | 100.00 |
| Properties and calculated values | 100° C. Kinematic viscosity of lubricating oil composition (unit: $mm^2/s$) | | 7.53 | 7.53 | 7.53 | 7.52 | 7.53 |
| | Total amount of the first rust inhibitor (B1) (unit: % by mass, based on total amount of lubricating oil composition) | | — | — | — | — | — |
| | Total amount of the fourth rust inhibitor (B4) (unit: % by mass, based on total amount of lubricating oil composition) | | — | — | — | — | — |
| | [(B1-1)/(B1-2)] (mass ratio) | | — | — | — | — | — |
| | [(B4-1)/(B4-2)] (mass ratio) | | — | — | — | — | — |
| Evaluation results | Rust inhibiting capability | Occurrence of rust | A | F | F | F | F |

TABLE 6

| | | | | Example | Comparative Example | | | |
|---|---|---|---|---|---|---|---|---|
| | | | | 5 | 20 | 21 | 22 | 23 |
| Composition of lubricating oil composition (unit: % by mass) | Base oil (A): base oil satisfying condition (α) | | | 98.77 | 98.87 | 98.80 | 98.77 | 98.77 |
| | Base oil (A'): base oil not satisfying condition (α) | | | | | | | |
| | Rust inhibitor (B) | First rust inhibitor (B1) | Succinate (B1-1) | | | | | |
| | | | Sorbitan fatty acid ester (B1-2) | | | | | |
| | | Second rust inhibitor (B2) | Carboxylic acid amide (B2-1) | | | | | |
| | | Third rust inhibitor (B3) | Neutral alkyl phosphate (B3-1) | | | | | |
| | | Fourth rust inhibitor (B4) | Fatty acid having 12 or more carbon atoms (B4-1) | 0.03 | 0.03 | | | |
| | | | Primary amine (B4-2) | 0.10 | | 0.10 | 0.10 | 0.10 |
| | Rust inhibitor (B') | Benzotriazole-based compound | | | | | | |
| | | Phosphorus-based compound 1 | | | | | | |
| | | Phosphorus-based compound 2 | | | | | | |
| | | Fatty acid having less than 12 carbon atoms 1 | | | | | 0.03 | |
| | | Fatty acid having less than 12 carbon atoms 2 | | | | | | 0.03 |
| | | Sarcosine derivative | | | | | | |
| | Antioxidant (C) | Phenol-based antioxidant | | 0.6 | 0.6 | 0.6 | 0.6 | 0.6 |
| | Anti-wear agent (D) | Tricresyl phosphate | | 0.4 | 0.4 | 0.4 | 0.4 | 0.4 |
| | Anti-foaming agent (E) | Silicone-based anti-foaming agent | | 0.1 | 0.1 | 0.1 | 0.1 | 0.1 |
| | Total content | | | 100.00 | 100.00 | 100.00 | 100.00 | 100.00 |
| Properties and calculated values | 100° C. Kinematic viscosity of lubricating oil composition (unit: $mm^2/s$) | | | 7.53 | 7.53 | 7.53 | 7.53 | 7.53 |
| | Total amount of the first rust inhibitor (B1) (unit: % by mass, based on total amount of lubricating oil composition) | | | — | — | — | — | — |
| | Total amount of the fourth rust inhibitor (B4) (unit: % by mass, based on total amount of lubricating oil composition) | | | 0.13 | 0.03 | 0.10 | 0.13 | 0.13 |
| | [(B1-1)/(B1-2)] (mass ratio) | | | — | — | — | — | — |
| | [(B4-1)/(B4-2)] (mass ratio) | | | 0.30 | — | 0.00 | 0.00 | 0.00 |
| Evaluation results | Rust inhibiting capability | Occurrence of rust | | A | F | F | F | F |

TABLE 7

| | | | | Example | | | | |
|---|---|---|---|---|---|---|---|---|
| | | | | 1 | 2 | 3 | 4 | 5 |
| Composition of lubricating oil | Base oil (A): base oil satisfying condition (α) | | | 98.80 | 98.80 | 98.70 | 98.89 | 98.77 |
| | Base oil (A'): base oil not satisfying condition (α) | | | | | | | |
| | Rust inhibitor (B) | First rust inhibitor (B1) | Succinate (B1-1) | 0.05 | | | | |
| | | | Sorbitan fatty acid ester (B1-2) | 0.05 | | | | |

TABLE 7-continued

| | | | | Example | | | | |
|---|---|---|---|---|---|---|---|---|
| | | | | 1 | 2 | 3 | 4 | 5 |
| composition (unit: % by mass) | | Second rust inhibitor (B2) | Carboxylic acid amide (B2-1) | | 0.10 | 0.20 | | |
| | | Third rust inhibitor (B3) | Neutral alkyl phosphate (B3-1) | | | | 0.01 | |
| | | Fourth rust inhibitor (B4) | Fatty acid having 12 or more carbon atoms (B4-1) | | | | | 0.03 |
| | | | Primary amine (B4-2) | | | | | 0.10 |
| | Rust inhibitor (B') | Benzotriazole-based compound | | | | | | |
| | | Phosphorus-based compound 1 | | | | | | |
| | | Phosphorus-based compound 2 | | | | | | |
| | | Fatty acid having less than 12 carbon atoms 1 | | | | | | |
| | | Fatty acid having less than 12 carbon atoms 2 | | | | | | |
| | | Sarcosine derivative | | | | | | |
| | Antioxidant (C) | Phenol-based antioxidant | | 0.6 | 0.6 | 0.6 | 0.6 | 0.6 |
| | Anti-wear agent (D) | Tricresyl phosphate | | 0.4 | 0.4 | 0.4 | 0.4 | 0.4 |
| | Anti-foaming agent (E) | Silicone-based anti-foaming agent | | 0.1 | 0.1 | 0.1 | 0.1 | 0.1 |
| | Total content | | | 100.00 | 100.00 | 100.00 | 100.00 | 100.00 |
| Properties and calculated values | 100° C. Kinematic viscosity of lubricating oil composition (unit: $mm^2/s$) | | | 7.53 | 7.53 | 7.53 | 7.53 | 7.53 |
| | Total amount of the first rust inhibitor (B1) (unit: % by mass, based on total amount of lubricating oil composition) | | | 0.10 | — | — | — | — |
| | Total amount of the fourth rust inhibitor (B4) (unit: % by mass, based on total amount of lubricating oil composition) | | | — | — | — | — | 0.13 |
| | [(B1-1)/(B1-2)] (mass ratio) | | | 1.00 | — | — | — | — |
| | [(B4-1)/(B4-2)] (mass ratio) | | | — | — | — | — | 0.30 |
| Evaluation results | Rust inhibiting capability | Occurrence of rust | | A | A | A | A | A |
| | Demulsibility | | | 40-39-1(10) | 40-40-0(5) | 40-39-1(5) | 40-40-0(15) | 40-40-1(15) |

<Discussion on Results in Table 1: Relationship Between Variation of Base Oil and Rust Inhibiting Capability 1>

The following matters are understood from the results shown in Table 1.

The chromatogram of the base oil (A) has a peak (first peak) in a range of a number of carbon atoms of more than 11 and less than 23, and thus satisfies the condition (α). Accordingly, it is understood that the base oil (A) is a base oil that contains a polar substance that has a function significantly deteriorating the rust inhibiting capability.

The chromatogram of the base oil (A) also has a peak (second peak) in a range of a number of carbon atoms of 23 or more and 50 or less.

The intensity ratio [(first peak intensity)/(second peak intensity)] of the first peak and the second peak in the chromatogram of the base oil (A) is 0.31.

On the other hand, the chromatogram of the base oil (A') does not have a peak (first peak) in a range of a number of carbon atoms of more than 11 and less than 23, and thus does not satisfy the condition (α). Accordingly, it is understood that the base oil (A') is a base oil that substantially does not contain a polar substance that has a function significantly deteriorating the rust inhibiting capability.

<Discussion on Results in Table 1: Relationship Between Variation of Base Oil and Rust Inhibiting Capability 2>

The following matters are understood from the results shown in Table 1.

It is understood that in the case where the base oil (A') that does not satisfy the condition (α) and substantially does not contain a polar substance that has a function significantly deteriorating the rust inhibiting capability is used as in the lubricating oil composition of Reference Example 1, an excellent rust inhibiting capability can be secured by blending the succinate (B1-1).

On the other hand, it is understood that in the case where the base oil (A) that satisfies the condition (α) and contains a polar substance that has a function significantly deteriorating the rust inhibiting capability is used as in the lubricating oil composition of Comparative Example 1, an excellent rust inhibiting capability cannot be sufficiently secured by blending the succinate (B1-1) as similar to Reference Example 1.

It is understood that even in the case where the succinate (B1-1) and the sarcosine derivative (N-alkylsarcosine), i.e., a combination of known rust inhibitors, are used as in the lubricating oil composition of Comparative Example 24, an excellent rust inhibiting capability cannot be sufficiently secured with the use of the base oil (A).

<Discussion on Results in Tables 2 and 3: Evaluation Results of Rust Inhibiting Capability of First Rust Inhibitor (B1)>

The following matters are understood from the results shown in Tables 2 and 3.

It is understood from the results shown by Example 1 that even in the case where the base oil (A) satisfying the condition (α) is used, a lubricating oil composition excellent in rust inhibiting capability can be provided by using the first rust inhibitor (B1) and satisfying the condition (ß).

On the other hand, it is understood from the results shown by Comparative Examples 1 to 3 that the single use of the succinate (B1-1) as the rust inhibitor cannot secure the rust inhibiting capability of the lubricating oil composition containing the base oil (A) satisfying the condition (α).

It is understood from the results shown by Comparative Examples 4 and 5 that the single use of the sorbitan fatty acid ester (B1-2) as the rust inhibitor cannot secure the rust inhibiting capability of the lubricating oil composition containing the base oil (A) satisfying the condition (α).

It is understood from the results shown by Comparative Examples 6 and 7 that even though the succinate (B1-1) and the sorbitan fatty acid ester (B1-2) are used in combination, the rust inhibiting capability of the lubricating oil composition containing the base oil (A) satisfying the condition (α) cannot be secured unless the condition (ß) is satisfied.

It is understood from the results shown by Comparative Examples 8 to 14 that in the case where the succinate (B1-1) and the benzotriazole compound are combined, and the case where the sorbitan fatty acid ester (B1-2) and the benzotriazole compound are combined, the rust inhibiting capability of the lubricating oil composition containing the base oil (A) satisfying the condition (α) cannot be secured.

<Discussion on Results in Table 4: Evaluation Results of Rust Inhibiting Capability of Second Rust Inhibitor (B2)>

The following matters are understood from the results shown in Table 4.

It is understood from the results shown by Examples 2 and 3 that even in the case where the base oil (A) satisfying the condition (α) is used, a lubricating oil composition excellent in rust inhibiting capability can be provided by using the second rust inhibitor (B2) and satisfying the condition (ß).

On the other hand, it is understood from the results shown by Comparative Example 15 that even though the second rust inhibitor (B2) is used, the rust inhibiting capability of the lubricating oil composition containing the base oil (A) satisfying the condition (α) cannot be secured unless the condition (ß) is satisfied.

<Discussion on Results in Table 5: Evaluation Results of Rust Inhibiting Capability of Third Rust Inhibitor (B3)>

The following matters are understood from the results shown in Table 5.

It is understood from the results shown by Example 4 that even in the case where the base oil (A) satisfying the condition (α) is used, a lubricating oil composition excellent in rust inhibiting capability can be provided by using the third rust inhibitor (B3) and satisfying the condition (ß).

On the other hand, it is understood from the results shown by Comparative Examples 16 and 17 that even though the third rust inhibitor (B3) is used, the rust inhibiting capability of the lubricating oil composition containing the base oil (A) satisfying the condition (α) cannot be secured unless the condition (ß) is satisfied.

It is understood from the results shown by Comparative Examples 18 and 19 that the use of the amine salt of an acidic phosphate or the hydrogenphosphite cannot secure the rust inhibiting capability of the lubricating oil composition containing the base oil (A) satisfying the condition (α).

<Discussion on Results in Table 6: Evaluation Results of Rust Inhibiting Capability of Fourth Rust Inhibitor (B4)>

The following matters are understood from the results shown in Table 6.

It is understood from the results shown by Example 5 that even in the case where the base oil (A) satisfying the condition (α) is used, a lubricating oil composition excellent in rust inhibiting capability can be provided by using the fourth rust inhibitor (B4) and satisfying the condition (ß).

On the other hand, it is understood from the results shown by Comparative Example 20 that the single use of the fatty acid having 12 or more carbon atoms (B4-1) as the rust inhibitor cannot secure the rust inhibiting capability of the lubricating oil composition containing the base oil (A) satisfying the condition (α).

It is understood from the results shown by Comparative Example 21 that the single use of the primary amine (B4-2) as the rust inhibitor cannot secure the rust inhibiting capability of the lubricating oil composition containing the base oil (A) satisfying the condition (α).

It is understood from the results shown by Comparative Examples 22 and 23 that even though the primary amine (B4-2) and the fatty acid having less than 12 carbon atoms are used in combination, the rust inhibiting capability of the lubricating oil composition containing the base oil (A) satisfying the condition (α) cannot be secured.

<Discussion on Results in Table 7: Evaluation Results of Demulsibility>

The following matters are understood from the results shown in Table 7.

It is understood that all the lubricating oil compositions of Examples 1 to 5 are excellent in demulsibility.

Among Examples 1 to 5, the lubricating oil compositions using the first rust inhibitor (B1) and the second rust inhibitor (B2) each exhibit a short period of time required for separation, from which it is understood that these are particularly excellent in demulsibility.

The invention claimed is:

1. A lubricating oil composition, comprising:

a base oil; and a rust inhibitor, wherein a gas chromatogram of the base oil measured according to ASTM D7500 with a gas chromatography distillation equipment has a peak in a range of a number of carbon atoms of more than 11 and less than 23, the rust inhibitor includes, based on a total amount of the lubricating oil composition, at least one selected from the group consisting of more than 0.02% by mass and less than 0.16% by mass of a first rust inhibitor, more than 0.05% by mass and 0.5% by mass or less of a second rust inhibitor, 0.005% by mass or more and less than 0.05% by mass of a third rust inhibitor, and more than 0.05% by mass and less than 0.20% by mass of a fourth rust inhibitor, where the first rust inhibitor is a combination of a succinate and a sorbitan fatty acid ester, the second rust inhibitor is a carboxylic acid amide, the third rust inhibitor is a neutral alkyl phosphate, and the fourth rust inhibitor is a combination of a fatty acid having 12 or more carbon atoms and a primary amine, and the base oil has a flash point of 250° C. or more by Cleveland open cup method, a density of 0.8300 g/cm$^3$ or less at 15° C., a viscosity index of 100 or more, and a kinematic viscosity of 7.50 mm$^2$/s or more and 9.00 mm$^2$/s or less at 100° C.

2. The lubricating oil composition according to claim 1, wherein the rust inhibitor comprises the first rust inhibitor, and the succinate comprises a polyhydric alcohol alkenylsuccinate.

3. The lubricating oil composition according to claim 1, wherein the rust inhibitor comprises the first rust inhibitor, and the sorbitan fatty acid ester comprises an ester compound of sorbitan and a fatty acid having 12 or more and 30 or less carbon atoms.

4. The lubricating oil composition according to claim 1, wherein the rust inhibitor comprises the second rust inhibitor, and the carboxylic acid amide has an acid value of 80 mgKOH/g or less.

5. The lubricating oil composition according to claim 1, wherein the lubricating oil composition further comprises at least one additive selected from the group consisting of an antioxidant, an anti-wear agent, and an anti-foaming agent.

6. The lubricating oil composition according to claim 1, wherein the lubricating oil composition is suitable as a turbine oil.

7. A lubrication method, comprising applying the lubricating oil composition according to claim 1 to a turbine.

8. A method for producing a lubricating oil composition, comprising:

mixing a base oil and a rust inhibitor, wherein a gas chromatogram of the base oil measured according to ASTM D7500 with a gas chromatography distillation equipment has a peak in a range of a number of carbon atoms of more than 11 and less than 23, the rust inhibitor includes, based on a total amount of the lubricating oil composition, at least one selected from the group consisting of more than 0.02% by mass and less than 0.16% by mass of a first rust inhibitor, more than 0.05% by mass and 0.5% by mass or less of a second rust inhibitor, 0.005% by mass or more and less than 0.05% by mass of a third rust inhibitor, and more than 0.05% by mass and less than 0.20% by mass of a fourth rust inhibitor, where the first rust inhibitor is a combination of a succinate and a sorbitan fatty acid ester, the second rust inhibitor is a carboxylic acid amide, the third rust inhibitor is a neutral alkyl phosphate, and the fourth rust inhibitor is a combination of a fatty acid having 12 or more carbon atoms and a primary amine, and the base oil has a flash point of 250° C. or more by Cleveland open cup method, a density of 0.8300 g/cm$^3$ or less at 15° C., a viscosity index of 100 or more, and a kinematic viscosity of 7.50 mm$^2$/s or more and 9.00 mm$^2$/s or less at 100° C.

9. The method according to claim 8, wherein the rust inhibitor comprises the first rust inhibitor, and the succinate comprises a polyhydric alcohol alkenylsuccinate.

10. The method according to claim 8, wherein the rust inhibitor comprises the first rust inhibitor, and the sorbitan fatty acid ester comprises an ester compound of sorbitan and a fatty acid having 12 or more and 30 or less carbon atoms.

11. The method according to claim 8, wherein the rust inhibitor comprises the second rust inhibitor, and the carboxylic acid amide has an acid value of 80 mgKOH/g or less.

12. The method according to claim 8, wherein the lubricating oil composition further comprises at least one additive selected from the group consisting of an antioxidant, an anti-wear agent and an anti-foaming agent.

13. The method according to claim 8, wherein the rust inhibitor comprises the third rust inhibitor, and the neutral alkyl phosphate conforms to formula (b3-1), (b3-1)

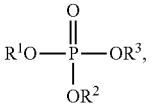

where $R^1$, $R^2$ and $R^3$ each independently represent an alkyl group having 3 to 14 carbon atoms.

14. The method according to claim 8, wherein the rust inhibitor comprises the fourth rust inhibitor, and the fatty acid having 12 or more carbon atoms has 12 to 20 carbon atoms.

15. The method according to claim 8, wherein the rust inhibitor comprises the fourth rust inhibitor, and the primary amine has a hydrocarbon group having 3 to 20 carbon atoms.

16. The method according to claim 8, wherein a total content of the base oil and the rust inhibitor is 80% by mass or more and less than 100% by mass, based on the total amount of the lubricating oil composition.

17. The lubricating oil composition according to claim 1, wherein the rust inhibitor comprises the third rust inhibitor, and the neutral alkyl phosphate conforms to formula (b3-1), (b3-1)

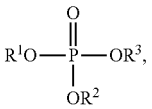

where $R^1$, $R^2$ and $R^3$ each independently represent an alkyl group having 3 to 14 carbon atoms.

18. The lubricating oil composition according to claim 1, wherein the rust inhibitor comprises the fourth rust inhibitor, and the fatty acid having 12 or more carbon atoms has 12 to 20 carbon atoms.

19. The lubricating oil composition according to claim 1, wherein the rust inhibitor comprises the fourth rust inhibitor, and the primary amine has a hydrocarbon group having 3 to 20 carbon atoms.

20. The lubricating oil composition according to claim 1, wherein a total content of the base oil and the rust inhibitor is 80% by mass or more and less than 100% by mass, based on the total amount of the lubricating oil composition.

* * * * *